United States Patent [19]

Donnelly

[11] 4,099,169

[45] Jul. 4, 1978

[54] ALARM DEVICE FOR DETAINING USER

[76] Inventor: Robert J. Donnelly, 28 Grandview Ave., Suffern, N.Y. 10901

[21] Appl. No.: 486,475

[22] Filed: Jul. 8, 1974

[51] Int. Cl.[2] ..... G08B 25/00

[52] U.S. Cl. ..... 340/304; 340/297

[58] Field of Search ..... 340/304, 297; 182/18

[56] References Cited

U.S. PATENT DOCUMENTS

| | | | |
|---|---|---|---|
| 1,429,668 | 9/1922 | Zakrzewski | 340/304 |
| 1,789,797 | 1/1931 | Wisniewski | 340/304 |
| 2,175,976 | 10/1939 | Strebel | 340/304 |

FOREIGN PATENT DOCUMENTS

| | | | |
|---|---|---|---|
| 420,742 | 10/1925 | Fed. Rep. of Germany | 340/304 |

*Primary Examiner*—Harold I. Pitts
*Attorney, Agent, or Firm*—Philip Furgang

[57] ABSTRACT

Provided is an alarm box in which the user is temporarily detained during the operation of the box. A handle switch is provided which, upon manual grasping causes the sending of a tamper signal. The handle is located on an alarm box housing. Cuffs are joined respectively to the alarm box housing (below the handle) and to a cover. The cover is pivotally joined to the housing for closing the cuffs upon the arm of the user. Within the cuffs are pressure sensitive switches that form a part of an electrical circuit. The closing of the handle switch and the cuff switch initiates the operation of a timing control. The timing control, in turn, activates a solenoid. A portion of the cover extends and is movable within the housing. That portion of the cover has a tear-shaped aperture which is engaged by the solenoid. The aperture is so disposed as to permit the inward (or toward the housing) movement of the cover but the combination with the solenoid's plunger, resist the removal of the cover. In this way, the user is held by the cuffs for a predetermined time. A local bell may be provided to indicate that the alarm box is properly operating. The closing of the buff switches and initiation of the timing control causes the sending of a primary signal or alarm.

57 Claims, 22 Drawing Figures

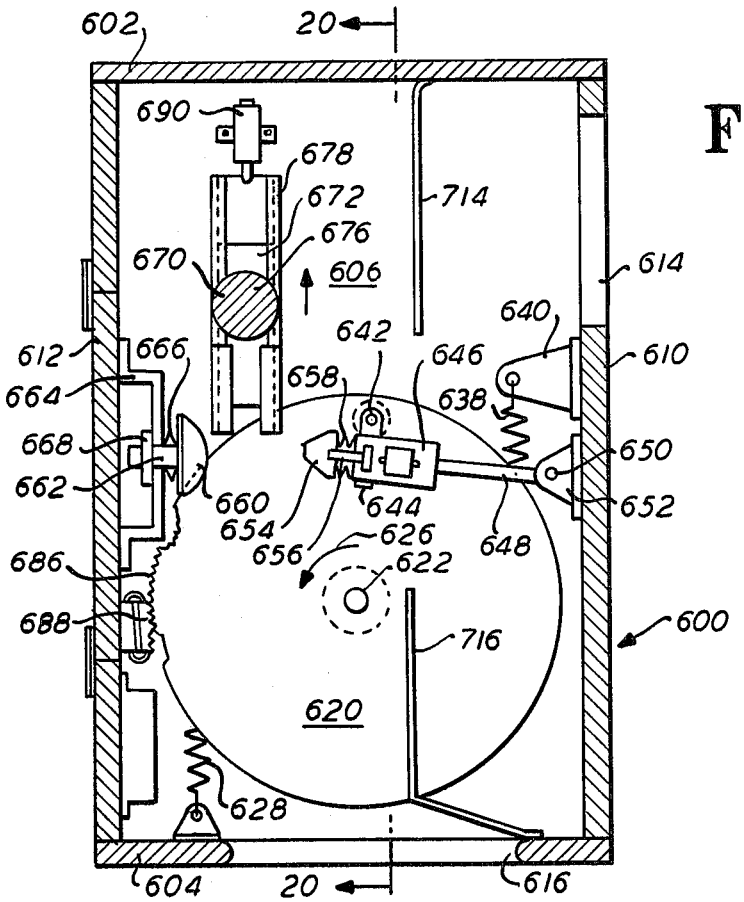
FIG. 19
FIG. 20
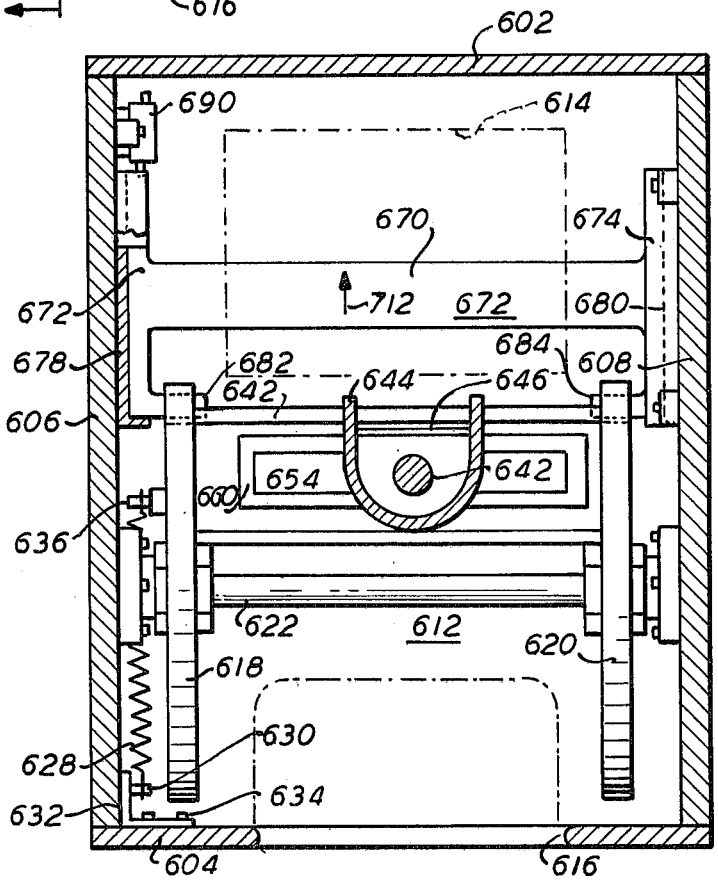

ALARM DEVICE FOR DETAINING USER

BACKGROUND OF THE INVENTION

This invention relates to alarm devices and more particularly, to those alarm devices in which an essential feature thereof is to engage and releasably hold the user.

False alarms are becoming an increasing problem in many suburban and urban areas. Each time a false alarm is answered by a fire alarm company, the equipment and men must be withdrawn from their headquarters and diverted to other areas of the community, thereby depriving the community of proper fire coverage. In addition, the high speeds at which fire companies must respond to alarms often endanger the lives of the fire company personnel as well as bystanders. Answering false alarms may, in other words, be measured in real terms of money lost and damaged lives and property. The increasing numbers of false alarms obviously places a greater demand upon fire companies, whether they be paid or volunteer.

Over the years, numerous attempts have been made to detain the user of a fire alarm box. The general idea of such devices is to lock and hold in place the person who sets off the fire alarm. Among those devices is that suggested by Hudgins (U.S. Pat. No. 48,204) in which the hand is passed into a box through a pair of manacles. Turning on the alarm closes the manacles about the wrist of the user, locking the user to the box until the fire department company releases him. A similar device has been suggested by Walsh (U.S. Pat. No. 545,141). Walsh adds a timing device which operates on the principle of an hourglass. When sand in a box runs out of the container, the manacles automatically open up.

Similar devices have been proposed by Hamer (U.S. Pat. No. 712,525); Janik (U.S. Pat. No. 1,155,578); Hutk (U.S. Pat. No. 1,288,901); and London (U.S. Pat. No. 2,121,206).

An interesting variation has been suggested by Zaomborsky (U.S. Pat. No. 2,301,989) in which the cuff is pivotally mounted to permit the user to remove his hand but not remove the cuff from attachment to the box. Another suggested device has been proposed by Seckendorf (U.S. Pat. No. 2,769,166) in which the individual is locked within a booth rather than to a fire alarm box.

Each of these aforementioned devices has a number of very serious defects which are believed to make their use undesirable, impractical, or uneconomical. Thus, the prior art devices require the initiation of the signal as a condition for locking the user to the box. There is no alternative to the user. An individual who places his hand in the proposed prior art devices and touches the signal initiating mechanism immediately finds himself restrained. A compulsive act followed by a change of mind is not excused by these prior art devices. A playful child or ignorant adult may become unnecessarily entangled.

In addition, there is neither an attempt to make the user aware that a cuff is about to enclose his hand nor is sufficient time given for him to remove his hand before sending the signal. Furthermore, more often than not the prior art devices do not provide means for automatically releasing the user. In this respect, the user must await the arrival of some member of the fire company to release the person sending the alarm.

In the instance of any and all false alarms being sent, it is a requirement of all the prior art devices that members of the fire company respond. No means are provided for separating alarm signals from a tampering signal. Finally, the aforementioned proposed systems are self-contained and are not adaptable to engage presently existing equipment.

SUMMARY OF THE INVENTION

It is thus an object of this invention to provide an alarm device for temporarily detaining the user.

It is a further object of this invention to provide an alarm device which provides a signal, separate and apart from the alarm signal, to indicate that the box has in some manner been disturbed.

It is still a further object of this invention to provide an alarm device which is simple in construction, economical to manufacture, and convenient in use.

These and other objects may become more apparent from the discussion found hereinafter.

In accordance with the teachings of this invention, there is an alarm providing device of the type requiring manual operation. This alarm device comprises secondary signal means for providing a secondary signal. Means are provided for detaining the user. Primary signal means are provided for supplying a primary or alarm signal. The primary signal means operates in response to the user being detained.

BRIEF DESCRIPTION OF THE DRAWING

FIG. 19 is a sectional view of still another alarm device constructed in accordance with the teachings of this invention;

FIG. 20 is a sectional view of an alarm device of FIG. 19 taken along lines 20—20;

DESCRIPTION OF THE PREFERRED EMBODIMENTS

Figure 1:
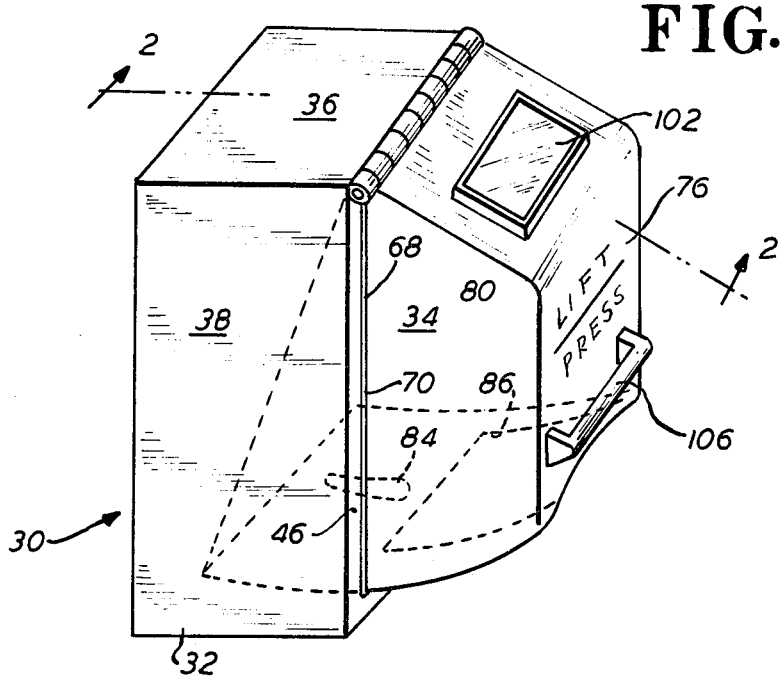
FIG. 1 is a perspective of an alarm device constructed in accordance with the teachings of this invention.
Figure 2:
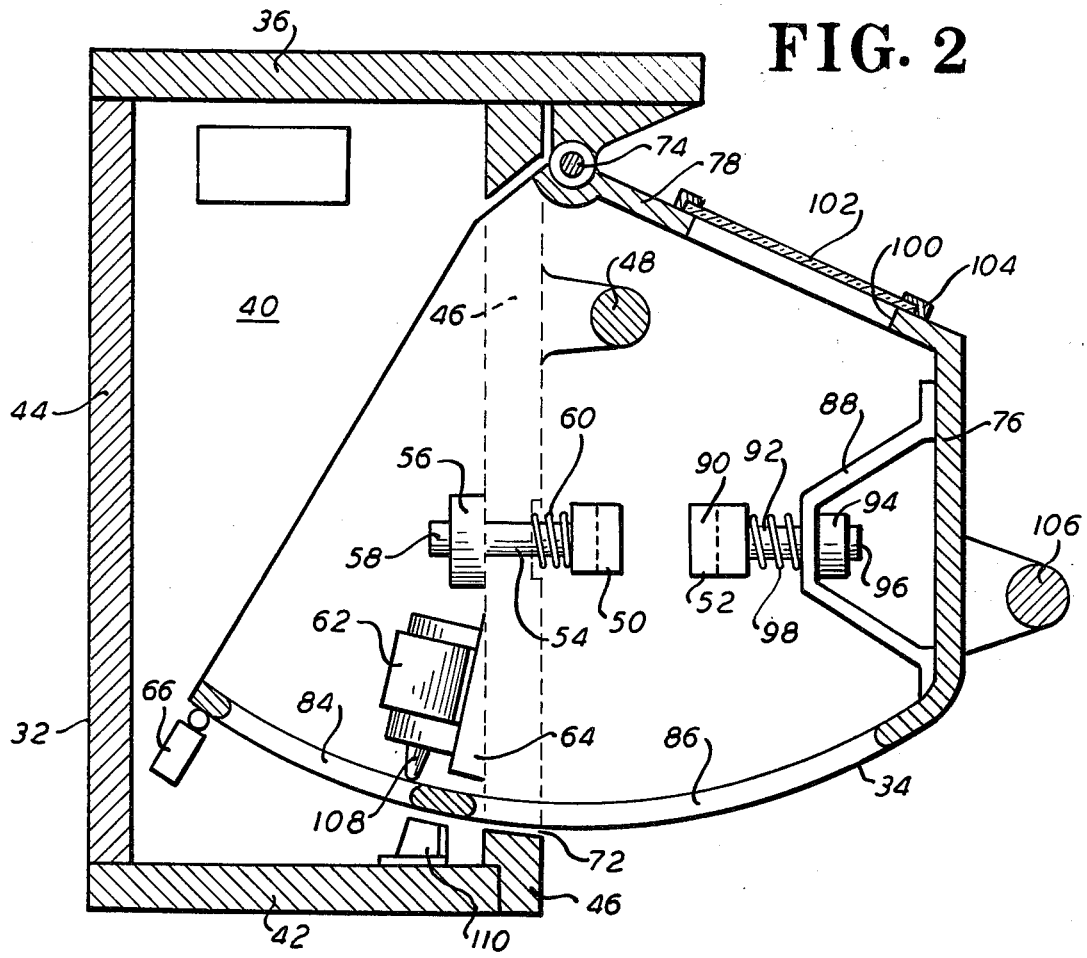
FIG. 2 is a sectional view of the alarm device of FIG. 1 taken along the lines 2—2.

The alarm device disclosed is particularly suited for fire alarm boxes. This device may be adapted for either stand alone use or in combination with existing fire alarm systems. Thus, turning to the drawing, there will be seen a fire alarm box 30 (FIG. 1-3) which generally comprises a main housing 32 and shield or cover housing 34. The main housing 32 may take any convenient shape. Since, as previously indicated, the alarm box 30 disclosed herein may be joined with pre-existing alarm boxes, it is preferable if the main housing 32 conforms generally to the shape of pre-existing alarm boxes. Thus, the main housing 32 of the alarm box 30 may have a generally rectangular shape and may be made of any structurally rigid material such as cast iron. Thus, the main housing 32 may comprise a top wall 36 (FIGS. 1 and 2) opposed parallel side walls 38 (FIG. 1), and 40 (FIG. 2), and a bottom wall 42 (FIG. 2). The top, side and bottom walls 36–42 may be joined by an integral back side wall 44. The front of the alarm box 30 is closed by a front side wall 46, thereby enclosing the alarm box main housing 32 and forming a substantially rectangular container. Secured to the exterior of the front side wall 46 and arranged horizontally may be a rigid handle 48. The handle 48 is arranged for being manually grasped, as will be more fully discussed hereinafter.

Spaced below the handle 48 and secured resiliently to the front side wall 46 may be one cuff 50 of a pair of hand cuffs 50 and 52. The cuffs 50 and 52 may be of a type well known in the art. Thus each cuff 50 and 52 may be C-shaped and arranged with C lying in a horizontal plane.

The first cuff 50 may be spaced from the front side wall 46 by means of a resiliently mounted rod or similarly rigid member 54. The rod 54 may pass through the front wall 46 of the housing 32 and secured therein. The rod 54 may form a part of a pressure-sensitive switch 56 of a type well known in the art. The enlarged portion 58 of the switch 56 may prevent the first cuff 50 from being pulled out of the front side wall 46. The switch 56 provides a resilient support for the cuff 50. A helical spring 60 about the rod 54 may be provided to give required tension and rigidity.

It should be noted that the spacing of the first cuff 50 from the front side wall 56 compels the manual grasping of the handle 48 to be accomplished by the hand reaching over the handle 48 and, with respect to FIG. 2, in a clockwise direction. Thus, the hand of the user (not shown) is oriented because of the disposition of the handle 48 and cuff 50 within the alarm box 30.

Secured within the rectangular main housing 32 and preferably to the front side wall 46 may be a solenoid 62 of a type well known in the art. The solenoid 62 may be secured by any well known means. It will be observed that the solenoid 62 is secured at acute angle with respect to the front wall 46, with the base of the solenoid 62 extending away from the front wall 46. This acute angle mounting of the solenoid 62 may be accomplished by such means as a bracket 64 or a shelf cast in the front wall 46, or any other similar means. The solenoid 62 is spaced beneath the cuff 50. The function of the solenoid 62 will be more fully discussed hereinafter.

Secured within the alarm box 30 is a cover housing sensing switch 66. This cover sensing switch 66 is a cam switch of a type well known in the art and is secured to the interior of the main housing 32 by a bracket (not visible). The purpose of this cover sensing switch 66 will be more fully discussed hereinafter.

Extending through the front side wall 46 may be a generally U-shaped aperture or opening 68 which generally comprises two substantially vertical side slots 70 joined at the base by a horizontal slot 72 (only one of the side slots 70 and part of a horizontal slot 72 are visible). The function of this U-shaped aperture 68 will be more fully discussed hereinafter.

Secured to the top wall 36 of the main housing 32, as by a hinge 74, and extending horizontally along the front side wall 46 may be the cover housing 34 which may have a generally scoop-like shape. The cover housing 34 may be pivotally mounted so that one wall 76 thereof will be substantially vertical when the alarm box 30 is not in use. It should be observed that the cover housing 34, which may be made of a similar rigid material as that of the main housing 32, is mounted for pivotal movement realtive to the main housing 32, and is weighted such that the front panel 76 maintains the substantially vertical relationship parallel to the front side wall 46 of the main housing 32. In this position, and extending at an acute angle with respect to the horizontal, is a second wall 78. This second wall 78 is parallel the front wall 46 and joins the hinge 74 to the front wall 76 of the cover 34. The front wall 76 and second wall 78 may be integrally joined to side panels 80. A base wall 82 of of the shield 34 may be arcuately contoured and be provided with a first and second aperture 84 and 86, respectively. The function of the first and second apertures 84 and 86 will be more fully discussed hereinafter. Thus, the walls 76, 78, 80, and 82 comprise the substantially scoop-shaped cover housing 34.

Within the cover housing 34 may be a substantially C-shaped bracket 88 secured to the front wall 76 as by welding or the like. The second cuff 52 is secured to the bracket 88 in a manner similar to that set forth in connection with the first cuff 50. Thus, the second cuff 52 is mounted for resilient movement with respect to the shield 34 by means of an integral rod or shaft 92 of a pressure-sensitive switch 94 passing through an aperture (not visible) in the C-bracket 88. The enlarged head 94 is on the opposed side of the C-bracket 88, thereby preventing the removal of the second cuff 52. The second cuff 52 is, as previously indicated, resiliently mounted with respect to the cover housing 34. A helical spring 98 serves the same purpose as the spring 60 employed in connection with the first cuff 50.

Extending through the second wall 78 of the cover housing 34 may be a panel or rectangular aperture 100, through which a user may easily see the main housing handle 48 and the cuffs 50 and 52. Access to the interior of the cover housing 34 may be blocked as by means of a translucent heavy guage plastic or glass panel 102 which may be held in place by a frame 104 secured by welding or other means to the cover housing 34. The front wall 76 of the cover housing 34 may have thereon a handle 106 lying in a horizontal plane for manually grasping and hingedly moving the cover housing 34.

As has been previously noted, the cover housing 34 is pivotally secured to the main housing 32 by the hinge 74. The side panels 80 of the cover housing 34 are disposed to move within the vertical side slots 70 of the U-shaped aperture 68. The base wall 82 of the shield housing 34 is disposed to move freely within the horizontal joining slot 72 of the U-shaped aperture 68. Thus, the arcuate shape of the base wall 82 is clearly desirable since the pivotally mounted shield 34 will follow an arcuate path as it is moved into and out of the rectangularly shaped main housing 32.

Figure 3:
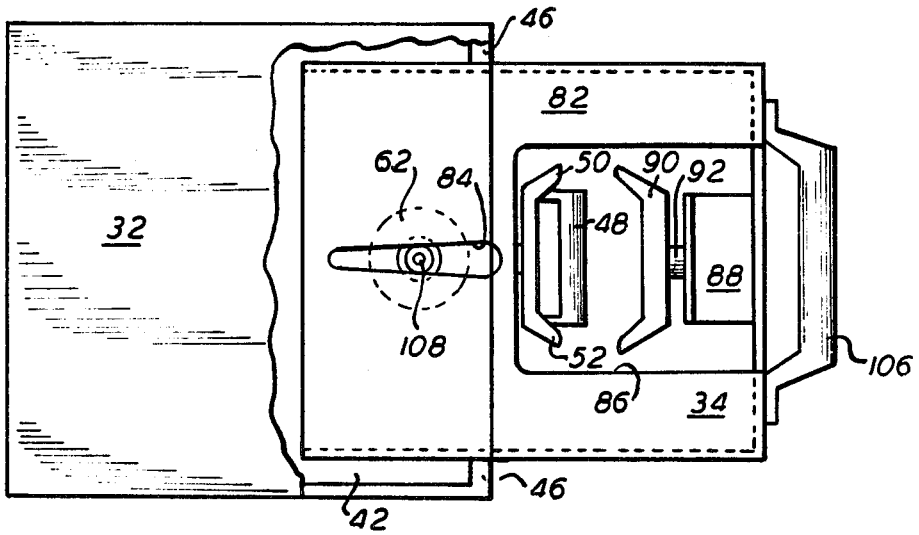
FIG. 3 is a partially sectioned bottom view of the alarm device of FIG. 1.

As previously noted, the base wall 82 of the shield housing 34 is provided with two apertures 84 and 86 respectively. The first of these apertures 84 has a generally elongated tear shape (FIG. 3) with the principal axis thereof lying perpendicular to the front wall 46 of the main housing 32. This tearshaped aperture 84 is principally within the housing 32 and narrows from the front wall 76 of the cover 34 toward the back wall 44 of the main housing 32. The plunger 108 of the solenoid 62 may be disposed to move outwardly and in a substantially vertical direction. The plunger 108 may have a conical end which is intended to engage the tear-shaped aperture 84. Thus, it will be seen (FIG. 2) that the purpose of the acute angle mounting of the plunger 62 is to insure that the conical end of the plunger 108 engages the tear-shaped aperture 84 at substantially right angles (FIG. 3).

The second aperture 86 within the shield 34 is substantially rectangular in shape and disposed immediately below the cuffs 50 and 52.

As previously indicated, a switch (not visible) is located in the handle 48 on the main housing 34. The aforementioned cover sensing switch 66 is mounted so as to engage the bottom wall 82 of the cover 34 as it moves into and out of the main housing 32.

In operation, the user grasps the handle 106 of the shield housing 34, moving the cover housing 34 outwardly of the main housing 32. With the cover housing 34 sufficiently open, the user reaches in and manually grasps the handle 48. The switch in the handle 48 is then operated by the user by merely grasping of the rigid handle 48. In this instance, the switch in the handle 48 is preferably a bar-shaped miniature switch. As a result of the engatement of the handle 48, a secondary or tamper signal is provided by the alarm box 30. The means of providing the signal will be more fully discussed hereinafter The user thereafter closes the shield 34 upon his arm. The cuffs 50 and 52 are disposed several inches from the handle 48 so that it will grasp the wrist of most users. This distance has been observed to be relatively standard among most human beings. It has further been observed that the width of a human wrist extending across the back or front of a hand is substantially the same from adult to adult. If a child used the alarm box 30, the smaller dimensions of the arm are believed to result in approximately the same width arm being placed across the cuffs 50 and 52. Thus, the cuffs 50 and 52 may have uniform dimensions for engaging all users of the box 30 without fear of either having the box 30 become inoperative or not sensing the presence of the user. In sensing the presence of a user, two pressure-sensitive switches, one for each cuff 50 and 52 are closed when the shield 34 is closed. At the closing of the pressure-sensitive cuff switches 56 and 94, an alarm or primary signal is provided. It should be observed that the solenoid 62 is only energized after the wrist cuffs 50 and 52 sense the presence of the human arm. When the arm is sensed by the cuffs 50 and 52, the cone-shaped aperture plunger 108 engages the tear-shaped aperture 84. Because of the shape of the aperture 84, the cover 34 may not be pulled out of the alarm box main housing 32 but may be moved only inwardly. This arrangement secures the user to the box. Means are provided within the box (to be fully discussed hereinafter) to assure that the cover 34 remains in a closed position for a pre-determined period of time. Thereafter, the timing mechanism de-energizes the solenoid 62 pulling up the plunger 108 and permitting the user to remove his arm.

The alarm box 30 disclosed herein presents some very important features not presently available in prior art devices. Thus, one tampering with the alarm box 30 by grasping the handle 48 will send a tamper or secondary signal to the fire company. The fire company need not respond to this signal but may send someone else to investigate. Such a tamper signal may, for example, indicate that the handle 48 has been touched or the circuit in some other means opened, as by vandalization of the alarm box 30. With this device, needless referring to calls will be reduced. In addition, because the user of the box 30 look through the view panel 102, clearly seeing the cuffs 52 and handle 48, the user is not placed under any stress due to the engagement of his arm. Further, the knowledge of being able to see the wrist and hand grasped keeps the user fully advised of the status of the operation of the box 30. A sounding of a bell or other audible signal may also be supplied while the wrist is engaged, giving an audible notice to the user that the box 30 is in operation. By retaining the user in a fixed position for a predetermined period of time, and combining it with a view panel through which the means of engagement may be easily seen by the user, false alarms would be discouraged and those who would nevertheless operate the box 30 would be held for a sufficient time to be apprehended by the investigating authority, should the alarm be false. In order to prevent the forces against the plunger 108 of the solenoid 62 from pivotally bending the solenoid 62, a stop 110 may be secured to the bottom wall 42 of the housing 32. The plunger 108, when extended through the tear-shaped aperture 84, would engage the stop 110.

Figure 4:
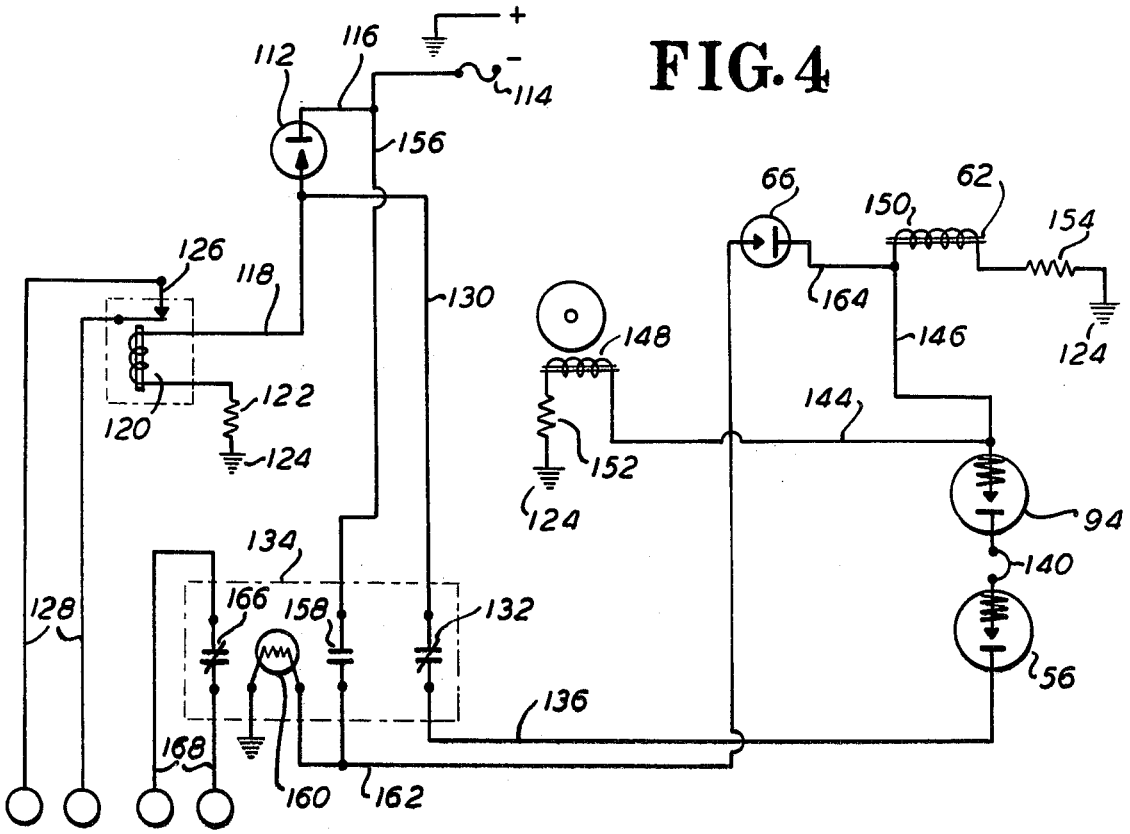
FIG. 4 is a schematic circuit diagram disclosing a control system for the alarm device of FIG. 1.

The electrical circuitry necessary to perform the operations set forth in connection with the mechanical operation of the box includes a handle switch 112 (schematically shown in FIG. 4). The handle switch 112 is a normally open, single-pole, single-throw switch and is an integral part of the handle 48. As previously indicated, this switch 112 is preferably a pressure-sensitive switch and may take any form such as a capacitance switch or the like. One side of the switch 112 may be coupled to a source of power, such as a DC voltage 114, by a line 116. The source of voltage 114 may take the form of a DC supply as that provided by a battery or the like (not shown) or by similar means. The other side of the handle switch 112 may be coupled through a line 118 to a relay coil 120. The other side of the relay coil 120 may be coupled through a resistor 122 to ground 124. The resistor 122 may be one typically used to protect a relay coil 120.

Responsive to the relay coil 120 may be a pair of normally closed contacts 126, which may be disposed across two sides of a secondary signal line 128 along which a secondary or tamper signal may be sent. The same side of the handle switch 112, which is coupled to the relay coil 122, may be coupled, via a line 130, to a first pair of normally closed timing contacts 132 of a timing control unit 134 of the type which normally has a cam operated timing motor. The other side of the first pair of normally closed timing contacts 132 is coupled, via line 136, to one side of a normally open, single-pole, single-throw cuff pressure-sensitive switch 56. The other side of the cuff switch 56 is coupled, via line 140, to one side of the second cuff pressure-sensitive switch 94 which is, like the first cuff switch 56, a normally open single-pole, single-throw switch. The other side of the second cuff switch 94 is coupled, via lines 144 and 146, to the coils 148 and 150 of an alarm bell and solenoid 62, respectively. The other side of the alarm bell coil 148 and solenoid coil 150 are in turn coupled through resistances 152 and 154, respectively, to ground 124.

The voltage source 114 is, in addition, coupled through line 156 to a normally open pair of contacts 158 of the timing control 134. The other side of the normally open contacts 158 are coupled on the one hand to the timing motor 160 and, on the other hand, via line 162 to the one side of the cover housing sensing switch 66. The cover switch 66 may be a normally open single-pole, single-throw cam switch, the other side of which is coupled via line 164 to the junction of the line 146 and the solenoid coil 150. Finally, there is provided a normally closed pair of contacts 166 of the timing control unit 134 to which is coupled across the primary signal or alarm line 168.

In reviewing the operation of the alarm box 30, it will be seen that when the handle switch 112 is closed, the relay 120 is energized, thereby opening the normally closed contacts 126. The open line 128 is thereby interpreted at the alarm headquarters as a tamper signal. It will be understood that while two separate lines 128 and 168 are shown for tamper or secondary signals and an alarm or primary signal, both signals may be disposed along the same line. In the alternative, the signals that are provided herein along lines 128 and 168 may instead be used to energize a presently existing alarm box, as will be more fully discussed hereinafter. Assuming now that a tamper signal has been sent in the manner set forth herein, by virtue of the closing of the handle switch 112; voltages are applied via line 30, to the normally closed contacts 132 of the timing control 134 and to one side of one of the cuff switches 56. It will be noted that unless the cuff switches 56 and 94 close, no further signals will be sent by the alarm box 30. This is essential, for it underlines the fact that if someone were to reach in and press close either one of the pressure-sensitive cuff switches 56 and 94, an alarm signal will not be sent along the line 168. This prohibits the type of tampering wherein someone places a broom handle merely closing only one of the switches 56 through cuff 50, and not energizing the handle switch 112 or the other cuff switch 94. Assuming now that the handle switch 112 has been closed and the cuffs 50 and 52 have engaged an arm, thereby closing the cuff switches 56 and 94, power from the source 114 is provided by line 116, the switch 112, line 130 contacts 132, line 136, first cuff switch 56 line 140, second cuff switch 94, line 146, through the solenoid 152 to ground 124, thereby energizing the solenoid 62, and at the same time, via line 144, to the audible alarm 148, giving an audible indication to the user that the alarm box 30 is now in use. The user, in the meanwhile, has moved the shield housing 34 inwardly closing the shield housing sensing switch 66 thereby placing voltage via line 162 on the timing motor 160. The energizing of the timing motor 160 closes the normally open contacts 158 to close. Voltages then applied from the source 114 along the line 156 directly through the now closed contacts of the normally open contacts 158 of the timing control 134 to the timing motor 160. This happens in the first instance upon the closing of the cover housing 34 upon the user's wrist, thereby closing the cuff switches 56 and 94. The user may then release the handle switch 112 without effecting the operation of the box 30. The first pair of normally closed contacts 132 remain closed for a predetermined period that it is desired for the individual using the alarm box 30 to be held in position. Thus, for example, the timing motor 160 may be set for a period of 5 or 6 minutes so that for a period of less than the present time, the first pair of normally closed contacts 132 will remain closed. The normally open contacts 138 of the timing control 134 will close within a few seconds after energization of the motor 160 and remain closed for the entire predetermined period of, for example, six minutes. The second pair of normally closed contacts 166, coupled to the primary line 168, will open several seconds after the energization of the timing motor 160 so as to provide sufficient time to be sure that the entire system is in operation. The alarm is thus sent within several seconds after the individual closes the cover 34 upon his wrist, closing the cuff switches 56 and 94. Shortly before the end of the predetermined period, the timing motor 160 causes the normally closed contacts 132 coupling the voltage source 114 to the cuff switches 56 and 94 to open, deenergizing the solenoid 150 and the audible alarm 148 and enabling the user to remove his hand. If the user leaves his hand within the box for several seconds thereafter, the entire system will recycle with the normally closed contacts 132 reclosing and providing energy again through the cuff switches 56 and 94. This is believed to be essential so that if for any reason the user wishes to, he may resend the alarm along the primary signal line 168. As previously indicated, the signal lines 168 may instead take the form of any means for operating a standard alarm.

Figure 5:
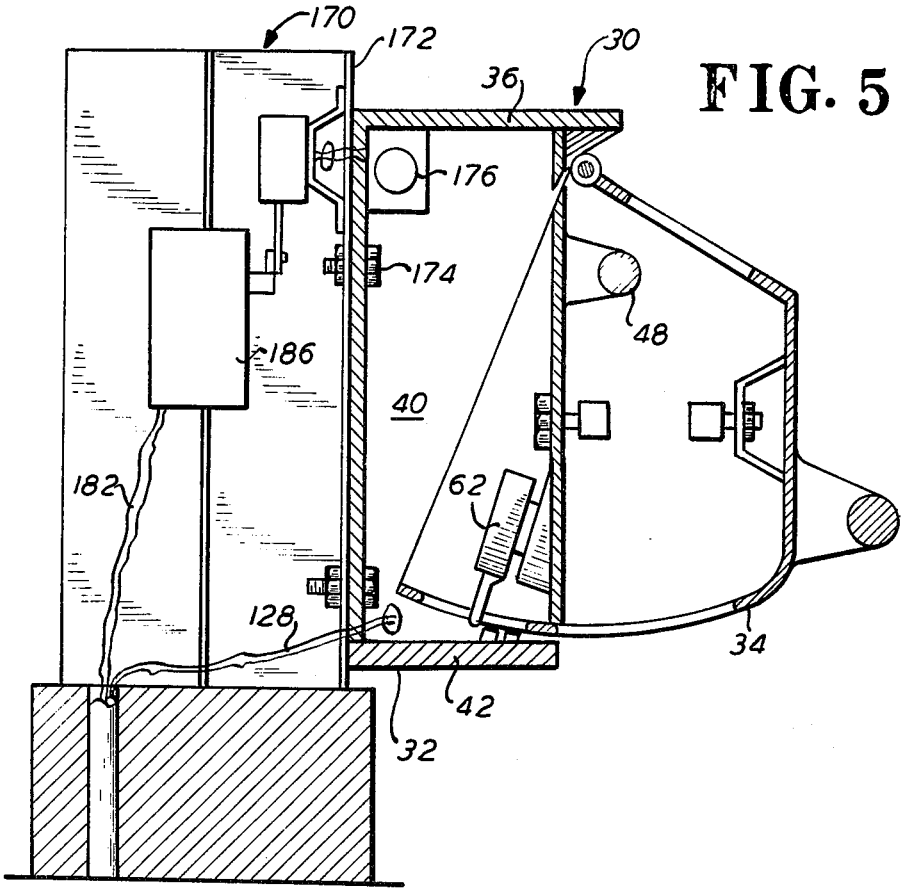
FIG. 5 is a sectional view of an alarm device of the type of FIG. 1 shown engaged to a pre-existing fire alarm box.
Figure 6:
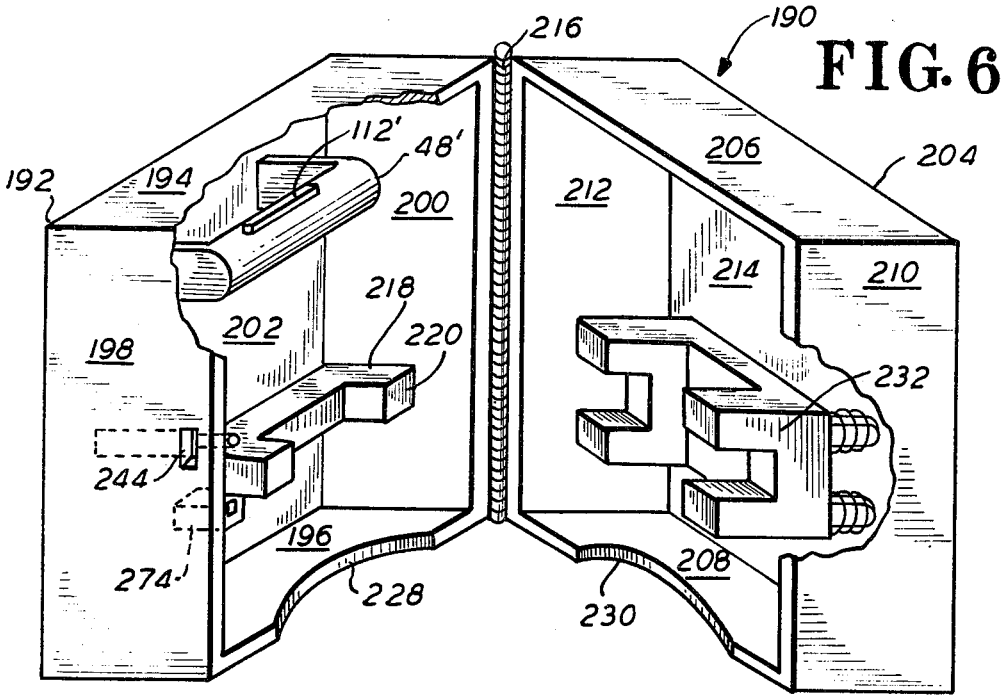
FIG. 6 is a perspective view of another alarm device with the cover housing open and constructed in accordance with the teachings of this invention.

The joining of the present alarm box 30 to a standard alarm box 170 (FIG. 5) may be simply done by bolting, for example, by joining the back wall 44 of the main housing 32, for example, to the front wall 172 of the standard alarm box 170 as by means of bolts 174 or the like. The tamper signal lines 128 of the alarm device 30 may be disposed into pre-existing lines or combined with the alarm or primary signal lines 168 in a manner well known in the art. On the other hand, the primary signal lines 168 may be coupled to a camming unit 176, secured within the main housing 32 and coupled appropriately to a matching solenoid 178, secured within the standard alarm box 170. The camming unit 176 in response to the primary signal may energize the solenoid 178 to operate a standard telegraph transmission system 180 of the standard alarm box 170, to thereby provide a signal along the alarm box 170, alarm lines 182. This joining of the alarm box 30 to a standard alarm box 170 is by example only and numerous methods of engagement and joining will easily come to mind, to thos experienced in the art.

It will be observed that, as previously indicated, the cover 34 is in a normally closed position with respect to the main housing 32. A frictional mount (not visible) in the hinge 74, as is well known in the art, will maintain the hinge cover in a normally closed position against the forces of wind or the like. In addition, it is clear that the operation of the cuff switches 56 and 94 may be determined in part by the tension provided by springs 98 and 60, respectively.

It should be noted that the alarm box 30 is a self-contained, self-run system. This means that no investigation will be required if the box 30 is properly used by someone sending a legitimate alarm. After the pre-determined period of, for example, six minutes has passed, the user will be released. It is only in the instance when a false alarm or that the box has been tampered with, does it become necessary for the box to be examined. The pre-determined time is intended to give the responding fire company an opportunity to answer a false alarm and to obtain the identify of the false alarm sender.

Figure 7:
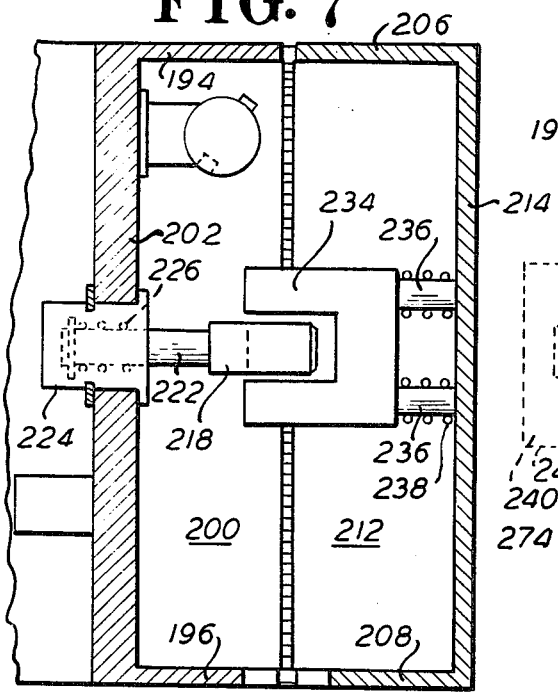
FIG. 7 is a sectional view of the alarm device of FIG. 6 with the cover housing in a closed condition.
Figure 8:
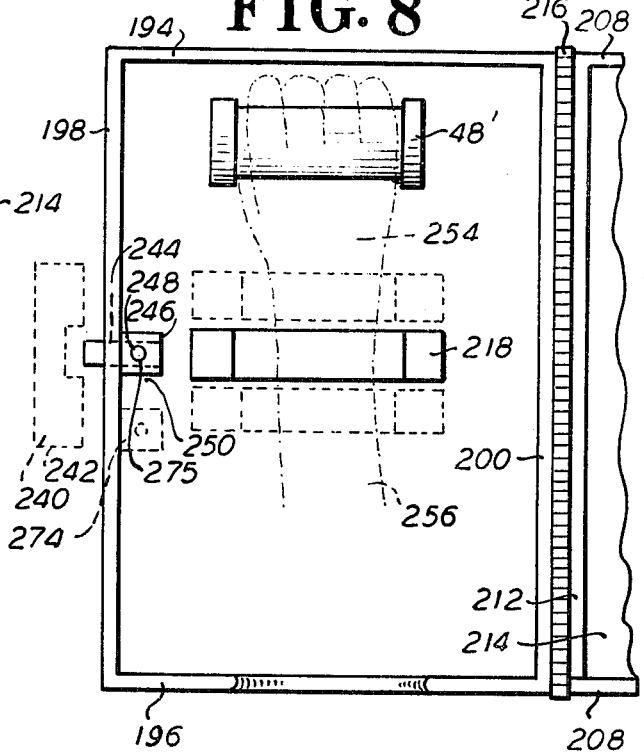
FIG. 8 is a front view of one side of the alarm device of FIG. 6.

Turning now to another embodiment, there is disclosed (FIGS. 7–9) another alarm box 190. The alarm box 190 may have any desired shape. As previously indicated, since prior art devices and particularly those alarm boxes presently in use, are substantially rectangular, the alarm box 190 may comprise a substantially rectangular housing. The main housing 192 may comprise a rectangular container having a top wall 194, a bottom wall 196 (opposed and parallel to top wall 194), two side walls 198 and 200, and a back wall 202, thereby forming an open rectangular container. Hingedly secured to the main housing 192 may be a similarly shaped cover housing 204. The cover housing 204 may comprise top and bottom walls 206 and 208, respectively, integrally joined to side walls 210 and 212 and a front wall 214. The cover housing 204, as previously indicated, is joined to the main housing 192 as by a hinge which may, for example, be in the form of a piano hinge 216, joined along one side wall 200 and 212 so that the cover housing 204 conveniently closes upon and encloses therein the main housing 192.

Within the main housing 192 and secured to the back wall 202 may be a rigidly mounted handle 48' of the type disclosed in connection with the first mentioned device, alarm box 30. Spaced below it may be a first cuff 218. The first cuff 218 may be generally C-shaped and arranged in a horizontal plane so as to enable the engagement of a wrist or other portion of the arm of the user. The distance between the handle 48' and the cuff 218 may have a spacing similar to the first device 30. As in the case of previous devices, the cuff 218 may be resiliently and movably mounted within a container 224. The rod 222 may have thereabout a resilient means, such as a coil spring 226 which is secured to the container 224. The container 224 may be joined to the rear housing through an aperture therein (not shown) by means of welding or the like. Within the bottom wall 196 of the main housing 192 may be an arcuate cut-out 228. In the cover housing 204, may be a similarly matched and opposed cut-out 230 so disposed as to form, with the cover 204 closed, an opening for allowing clearance for an arm secured within the alarm box 190. Secured to the front wall 214 of the cover housing 204 and residing therein may be a second cuff 232. This second cuff 232 may have a generally C-shape. The upstanding arms 234 of the C-shape of the second cuff 232 may be fiburcated for interlocking with the arms of the first cuff 218. The second cuff 232 may be resiliently mounted to the cover 204 as by support rods 236 and coil springs 238. The rods 236 may be rigidly secured to the front wall 214 of the cover 204 and may move freely within the second cuff 232. The second cuff 232 may be secured to the cover 204 by means well known in the art, and in accordance with the description of the first alarm box 30.

Figure 9:
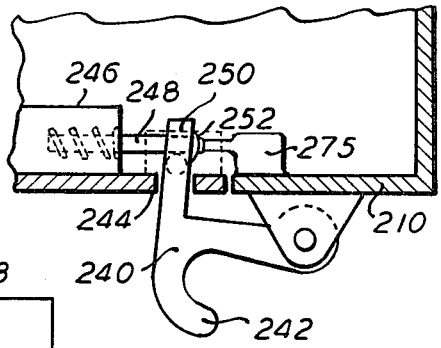
FIG. 9 is a fully sectioned partial view of an engaging latch of the alarm device of FIG. 6.

The cover 204 may have secured to the side 210, opposed to the hinge side 212, a latch 240 (FIGS. 8 and 9) pivotally secured thereto. The latch 240 may comprise a handle 242 (shown in phantom in FIG. 8) with an arm 250 (FIG. 9) for extending through and into an aperture 244 in the side wall 198. A solenoid 246 is secured to the housing side wall 198. The plunger 248 is extendable from the solenoid 246 and across the aperture 244. The handle arm 250, that extends laterally therefrom, engages the main housing 192 through the aperture 244 (FIG. 9). Within the arm 250 may be a hole 252 through which the plunger 248 of the solenoid 246 may easily extend.

The operation of the alarm box 190 of this invention is similar to that of the first mentioned alarm box 30. Thus, the user opens the cover 204 and grasps the handle 48' with one hand 254, placing the wrist against one of the cuffs 218. As before, pressing the alarm handle switch 112' produces a secondary or tamper signal. Closing the cover 204 upon the arm 256 of the hand 254 grasping the handle 48' closes the cuff switches 56 and 94, thereafter sending the alarm or primary signal and, at the same time, locking the cover housing 204 to the main housing 192 at the latch handle 242 for a predetermined period of time.

Figure 10:
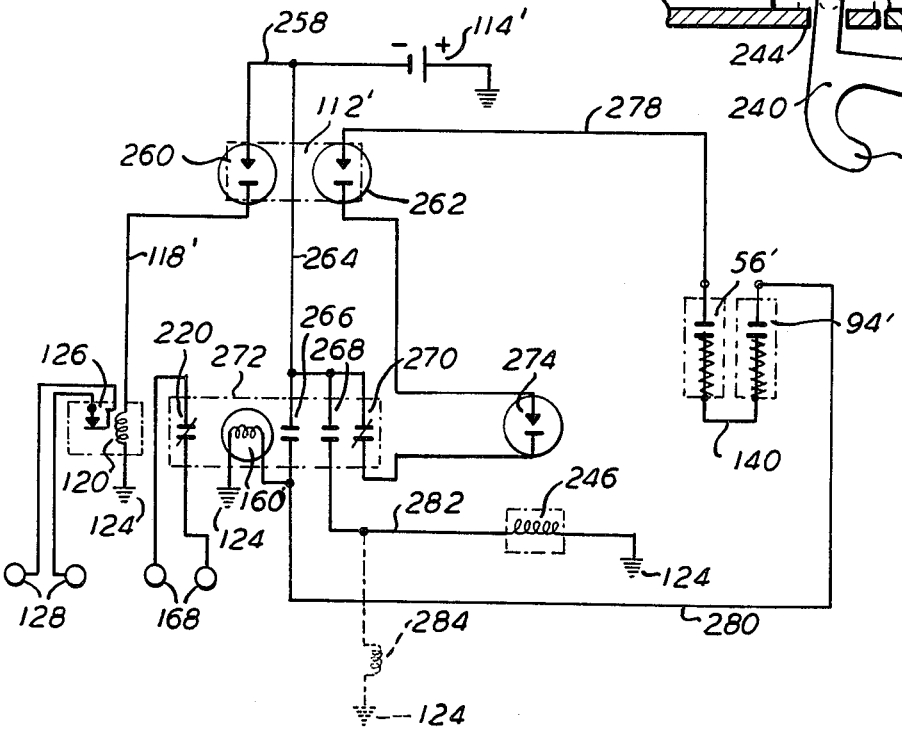
FIG. 10 is a schematic circuit diagram of a system for controlling the operation of the alarm device of FIG. 6.

The operation may be more fully understood with reference to the circuitry (FIG. 10) which is found enclosed within the alarm box housing 190. Thus, there may be provided (FIG. 10) a source of voltage 114' which may be, for example, a battery or any other convenient source of DC voltage, coupled via line 258 to the handle switch 112'. The handle switch 112' may take the form of two ganged, single-pole, single-throw switches 260 and 262 which are energized by the pressure upon the switch mechanism 112'. Thus, the source of voltage 114' is coupled through line 258 to a first of the handle switches 260. The other side of that switch 260 is coupled via line 118' to a relay 120 and then to ground 124. The normally closed contacts 126 associated with the relay coil 120 are connected across a secondary signal or tamper alarm line 128 and serves the same purpose as set forth in the aforementioned first alarm box 30.

Coupled to the source of voltage and to line 258 is a second line 264. The second line 264 is, in turn, joined to one side of two normally open and one normally closed timing contacts 266, 268, and 270, respectively, of a timing control 272. The other side of the normally closed contact 270 of the timing control 272 is connected to one side of a single-pole, normally open, single-throw latch switch 274. The latch switch 274 may be located within the aperture 244 so that when the latch arm 250 is extended within the aperture 244, the latch switch 274 closes. The other side of the latch switch 274 is coupled, via line 276, to one side of the second handle switch 262. The other side of the handle switch 262 is coupled, via line 278, to one side of the first cuff switch 56. The outer side of the cuff switch 56 is connected in series via line 140 to one side of the cuff switch 94, which is in turn connected, via line 280, to one side of the timing motor 160'. The other side of the timing motor 160 is connected to ground 124. At the juncture of the line 280 and the timing motor 160' is coupled the first normally open timing contact 226 of the timing control 272. The other side of the second normally open timing contacts 268 of the timing control 272 is coupled, via line 282, to the coil 284 of a bell and one side of the cover solenoid 246. The other side of the bell coil 284 and the cover solenoid 246 are respectively joined to ground 124. Finally, a second pair of normally closed timing contacts 166 is coupled across a primary signal line 168 for providing an alarm signal.

In operation, the hand 254 presses the handle switch 112' closing switches 260 and 262. The closing of switch 260 places voltage on line 118' energizing the coil 120, thereby opening the secondary signal line 128, giving an indication of a tamper signal. If the operator of the handle retains his hand in position and closes the cover housing 204 upon his arm 256, he thereby closes the cuff contact switches 56 and 94 and latch 240. The result of this act is that a complete circuit will be established from the voltage source 114', via line 264, through the normally closed contacts 270 of the switching device 272, the latch switch 274, the second handle switch 262, through the closed cuff switches 56 and 94, to engage the timing motor 160'. The timing motor 160' will cycle through a predetermined period of time which may be, for example, six minutes (as previously discussed). The second normally closed contacts 268 will close, energizing the cover solenoid 246 and locking the cover 204 closed for the predetermined period, setting off the bell 284 to indicate that the box 190 is in use. A few seconds after the cover 204 has been closed the first open timing contacts 266 will close, locking in the timing motor 160' during the remainder of the predetermined period. At approximately that time, the second normally closed timing contacts 220 will open, sending the primary or alarm signal. Shortly before the predetermined time has ended, the second pair of normally open timing contacts 268 will open, thereby permitting the cover solenoid 246 to release the latch 240 by withdrawing the plunger 248. The user may then open the cover 204. Shortly thereafter, the first pair of normally open contacts 266 of the timing control 272 will open. The timing motor 160' is de-energized and the user may remove his arm 254. In the event that the user wishes to resend the alarm, he merely keeps his hand 254 in place and the timing motor 160' will recycle. It is clear that the same benefits obtainable from the first system 30 may be used herein. Indeed, by a small modification, the circuitry of the first alarm box 30 may be easily adapted for the second alarm box 190 and vice versa. In a similar manner, the cuffs 50 and 52 and 218 and 252 of either devices are interchangeable, as are the mounting means. In addition, it is clear that, as previously discussed, this alarm box 190 may either stand alone or may be fitted to existing alarm boxes. This device differs from previous devices in that there is no panel through which the operation of the cuffs 220 and handle 48' may be seen and the manner in which the cover closes upon the user.

Figure 11:
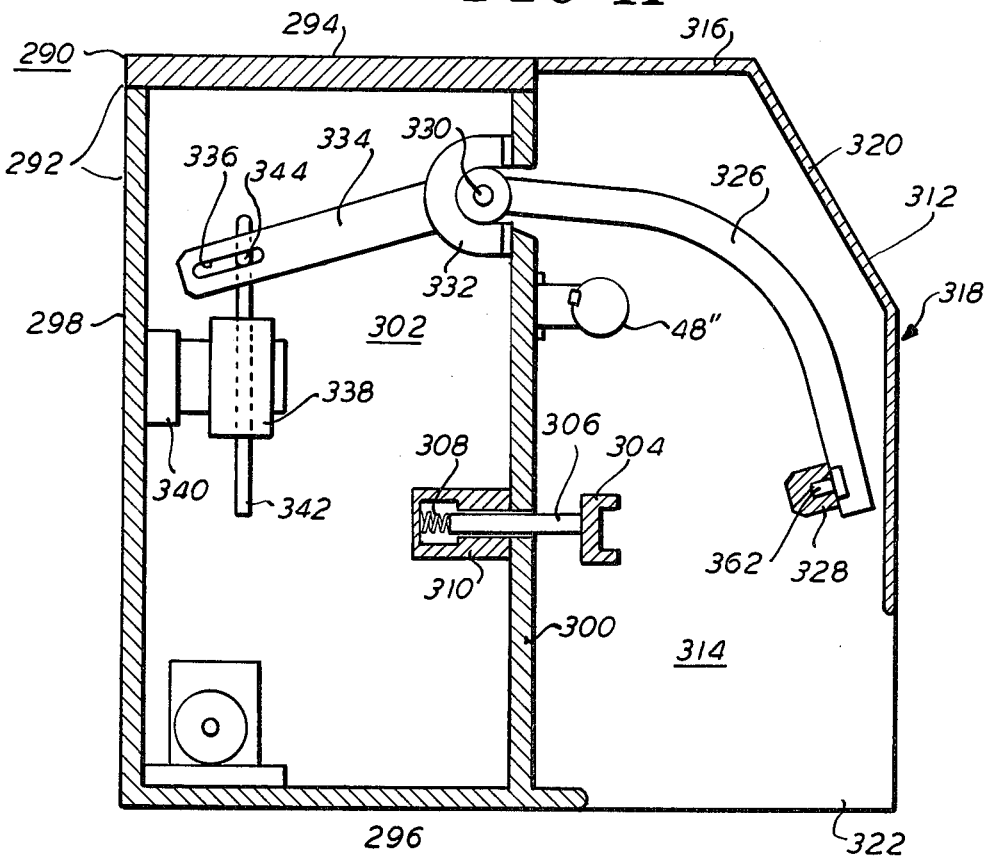
FIG. 11 is a sectional view of another alarm device constructed in accordance with the teachings of this invention.
Figure 12:
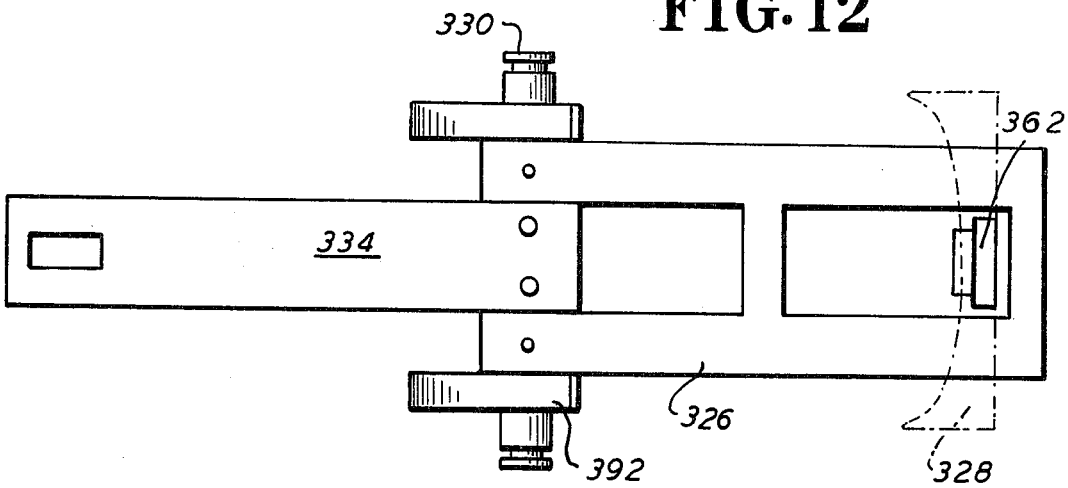
FIG. 12 is a top view of a pivotally mounted cuff arm of the type used in the alarm device of FIG. 11.
Figure 13:
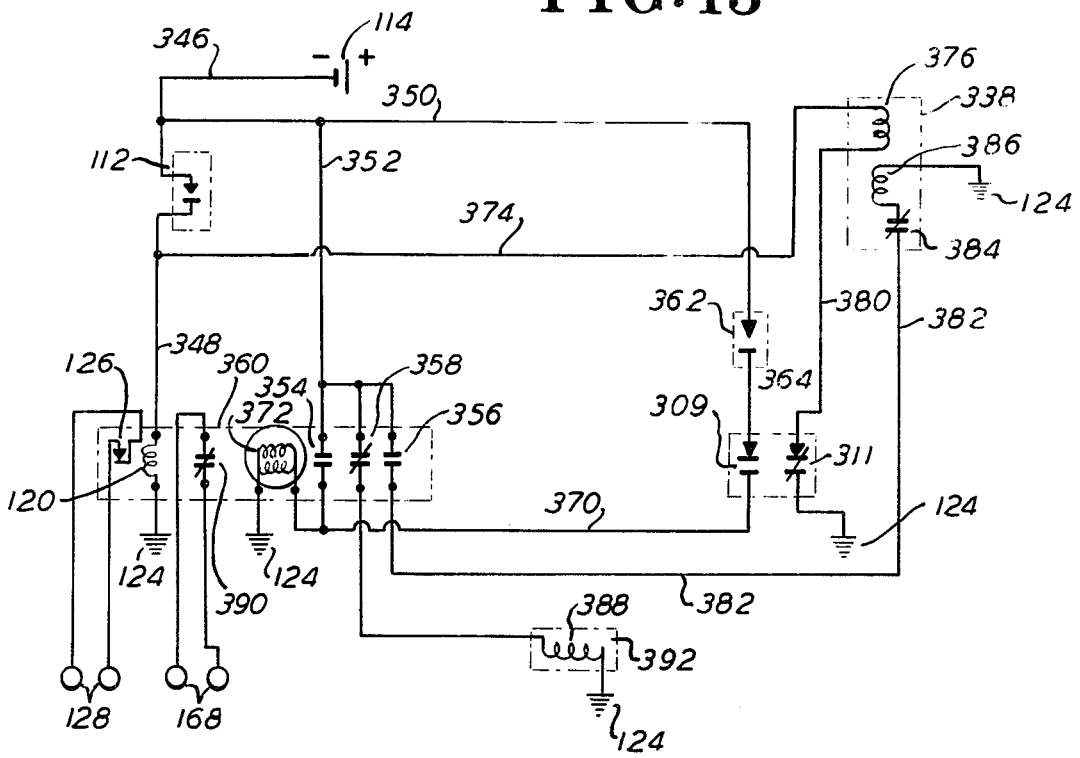
FIG. 13 is a schematic circuit diagram for a control system for the alarm device of FIG. 11.

Turning now to another embodiment of this invention, (FIGS. 11–13) there is disclosed a fully automatic alarm device 290 (FIG. 13). This alarm box 290 may comprise a housing 292 which, for the reasons previously discussed, may take any convenient form such as a generally rectangular shape. Thus, the housing 292 may comprise a top and bottom wall 294 and 296, respectively, a rear wall 298 and a front compartment wall 300, and side walls 302 to form a rectangular box-like structure. As with previous devices, a handle 48'' may be secured to the front wall 300. Spaced below and resiliently secured to the wall, may be one cuff 304. As with prior art devices, this first cuff 304 may be secured to a pressure-sensitive switch assembly 310 with shaft 306 extending through wall 300 mounted for resilient movement with respect to the wall 300 by means of a spring 308. The pressure-sensitive switch assembly 310 may have therein, for example, two pressure-sensitive switches 309 and 311, the function of which will be more fully discussed hereinafter. Extending over the front of the housing 292 and rigidly secured thereto, may be a second part of the housing 312 which encloses the cuff 304 and handle 48''. Thus, the second housing part 312 of the housing 292 may have side walls 314 as a contiguous part of the side walls 302 of the housing 292. Atop wall 316 may extend from the top wall 294 of the housing 292, and a generally parallel front wall 318 may be secured thereto. The front wall 318, which is joined to the side walls 314, may have an angulated front portion 320. This top, angulated front, and vertical front walls 316, 320, and 318, respectively, may be made of a translucent material so that the user of the alarm box 290 may see inside both the cuff 304 and the alarm handle 48''. An aperture 322 may be formed in the front wall 318 and through the bottom thereof so as to enable the person to reach into the alarm box 240.

Extending through an aperture in the front compartment wall 300 above the handle 48'' may be an arcuately shaped member or bar 326 which curves outwardly and downwardly with respect to the front panel 300. The bar 326 may be made of any rigid material and curved to permit access to the handle 48''. At one end of the bar 326 may be the second matching cuff 328. The bar 326 is secured to a shaft 330 and is pivotally mounted by a bracket 332 to the interior portion of the compartment side 300 of the housing 292. Rigidly secured to the shaft 330 and bar 326 is a downwardly extending arm 334 which may be, for example, a piece of flat rigid stock having a camming slot 336 at one end. A double action solenoid 338 may be rigidly secured, as by a bracket 340, to the rear wall 298 of the housing 292. The solenoid plunger 342 may be secured for vertical motion and may have a pin 344 for engaging the camming slot 336. An upward motion of the plunger 342 causes the pin 344 to move the arm 334 upwardly and the bar 326 downwardly so that the cuff 328 moves toward the opposing cuff 304.

A fuller understanding of the alarm box 290 of this embodiment may be more fully obtained with reference to the circuit diagram (FIG. 13) in which the handle switch 112 within the handle 48'' is a normally open, single-pole, single-throw switch. One side of the switch 112 is coupled, via line 346, to a source of DC voltage 114. The other side of the swtich 112 is coupled, via line 348, through a relay coil 120, to ground 124. The normally closed contacts 126 of the relay coil 120 are across a secondary signal line 128.

Coupled to the switch 112, at its junction with the line 346, are two additional lines 350 and 352. The power supply 114 is coupled, via line 346 and 352, to one common side of first and second normally open timing contacts 354 and 356, and a first normally closed timing contact 358 of a timing control 360. The power supply 114 is, in addition, coupled through line 346 and line 350 to one side of a normally open, single-pole, single-throw, pressure-sensitive cuff switch 362. This cuff switch 362 may be located in the movable cuff 328. The other side of this first cuff switch 362 may be joined, via line 364, to one of the pair of pressure-sensitive single-pole, single-throw, ganged switches 309, located in the housing cuff 304. This first 309 of the ganged switches 309 and 311 is normally open while the second 311 of these switches is normally closed. The line 364 couples the cuff switch 362 to the normally open cuff switch 309. The other side of the normally open cuff switch 309 may be coupled, via line 370, to the other side of the first normally open timing contacts 354 and the timing motor 372. The other side of the timing motor 372 is connected to ground 124. At the juncture of the switch 112 to line 348 is line 374. Line 374 couples the switch 112 to one side of one coil 376 of the double action solenoid 246. This first coil 376 is in turn coupled, via line 380, to one side of a normally closed second cuff switch 311. The other side of the second cuff switch 311 is connected to ground 124.

The other side of the second normally open timing contact 356 of the timing control 360 is coupled, via line 382, through a solenoid switch 384 having normally closed contacts, to the second coil 386 of the double action solenoid 378. The function of the solenoid switch 384 will be more fully discussed below. The other side of the first normally closed timing contacts 358 of the timing control 360 is coupled through a solenoid locking coil 388 to ground 124. Finally, a second pair of normally closed timing contacts 390 of the timing control 360 is placed across a primary signal line 168.

In operation, the user places his hand on the alarm handle 48", closing switch 112, which energizes the relay coil 120, opening the contacts 126, indicating a tamper signal on line 128. The closing of the handle switch 112 places the voltage on line 374 which in turn energizes the first coil 376 of the double action solenoid 338. As the plunger 342 moves upwardly, the pin engaging the slot 336 moves the arm 326 downwardly and the cuff 328 automatically closes upon the user's arm (not shown). As this is happening, the voltage is also placed on the solenoid lock coil 388 through the first normally closed contact 358 lines 352 and 346, permitting the cuff arm 326 to move downwardly. Within a few seconds, as might be expected, the cuff 328 closes on the arm of the user, opening the normally closed cuff switch 311 and closing the cuff switches 362 and 309, thereby completing a circuit including the power supply 114, lines 346, 350, cuff switches 362 and 309, lines 364 and 370, turning on the timing motor 372. After several seconds, the first normally closed timing contacts 358 open, locking the bar 326 in place. The arrangement of the lock may be more fully seen wherein the cuff arm 326 is shown joined by means of a solenoid controlled (coil 388) shaft lock 392, engaging the camming arm 334 (FIG. 12). A few seconds after the solenoid lock 392 has been disengaged by the opening of the first normally closed contacts 358, the first normally open contacts 354 close, thereby locking in the timing motor 372 to the power supply 114 for the aforementioned predetermined period of time. At this instance, the second normally closed timing contacts 360 open up, providing a primary signal on line 168. After the predetermined period of time has run, the normally closed timing contacts 358 of the timing control 360 will close, disconnecting the solenoid lock 392 and permitting the bar 326 to move upwardly. At that instant, the normally closed cuff switch 368 will open and the second, normally open timing contacts 356 of the timing control 360 will close, energizing the coil 378 of the double-action solenoid 338, causing the plunger 342 to be withdrawn, pulling up the arm 326, releasing the user. At the end of the travel of the plunger 342, the solenoid switch 384, which may be internal to the double-action solenoid 338, will open, fully disconnecting the double-action solenoid 338 from the circuitry and giving an opportunity for the user to remove his hand. As with previous devices, though not shown herein, a bell may be inserted in the circuitry to give audible notice to the user that the box is in operation.

Figure 14:
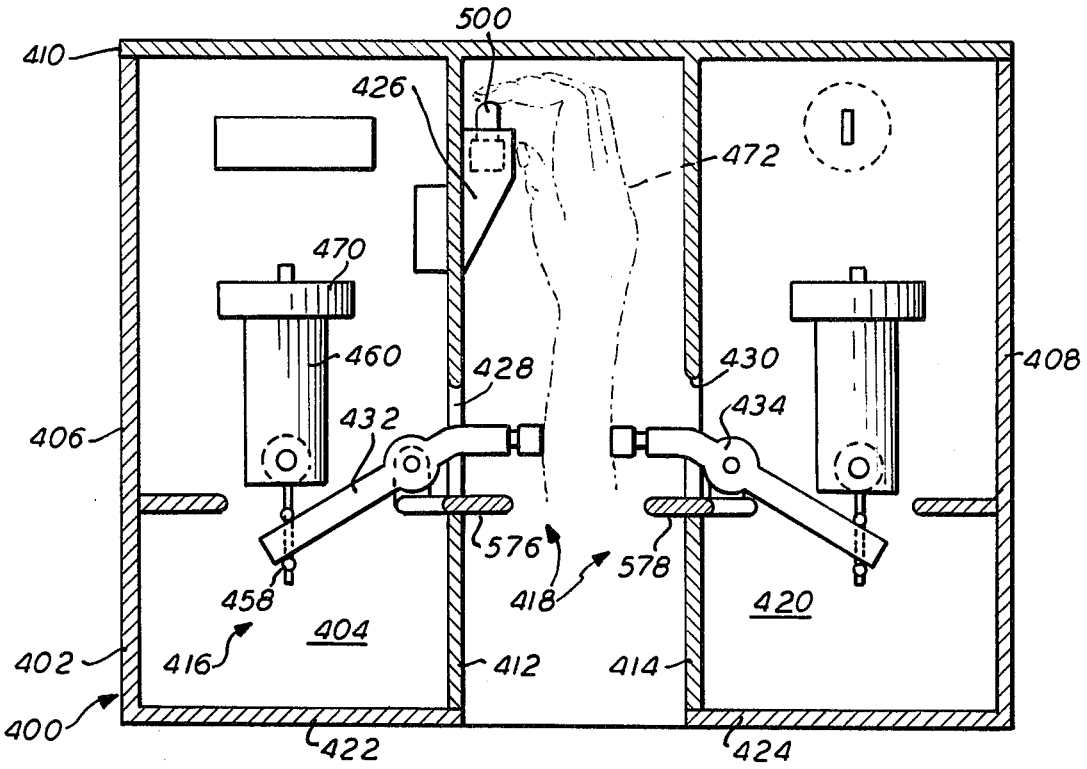
FIG. 14 is a sectional view of another alarm device constructed in accordance with the teachings of this invention.

Still another embodiment of an alarm box 400, comprises a housing 402 (FIG. 14) which has a substantially rectangular shape and may be made of any rigid material such as cast iron. The exterior is defined by a rectangularly shaped rear wall 404 and two opposed rectangular side walls 406 and 408, joined to a rectangular top wall 410. The housing 402 is divided substantially in thirds with two intermediate compartment walls 412 and 414, parallel the side walls 406 and 408. There are thus formed three separate compartments, 416, 418, and 420. The compartments on either side, 416 and 420, of the housing 402 may have their bottoms closed by rigid bottom walls 422 and 424, respectively. A space is left at the bottom of the center compartment 418, the function of which will be more fully described hereinafter.

The front wall of the center compartment 418 of the three-compartment housing 402 may be made of any translucent material, such as glass or plastic. It is the center compartment 418 into which the user places his hand. Within this center compartment 418 and secured to one of the compartment walls 414 and 416 may be a bracket secured ledge 426 which may have a pressure-sensitive switch (not indicated) such as a capacitance switch or the like. Pivotally secured within each of the two side compartments 416 and 420 and movable through apertures 428 and 430 in the compartment walls 412 and 414 are cuff arms 432 and 434. Each cuff arm 432 and 434 is pivotally mounted at substantially the center thereof.

Figure 15:
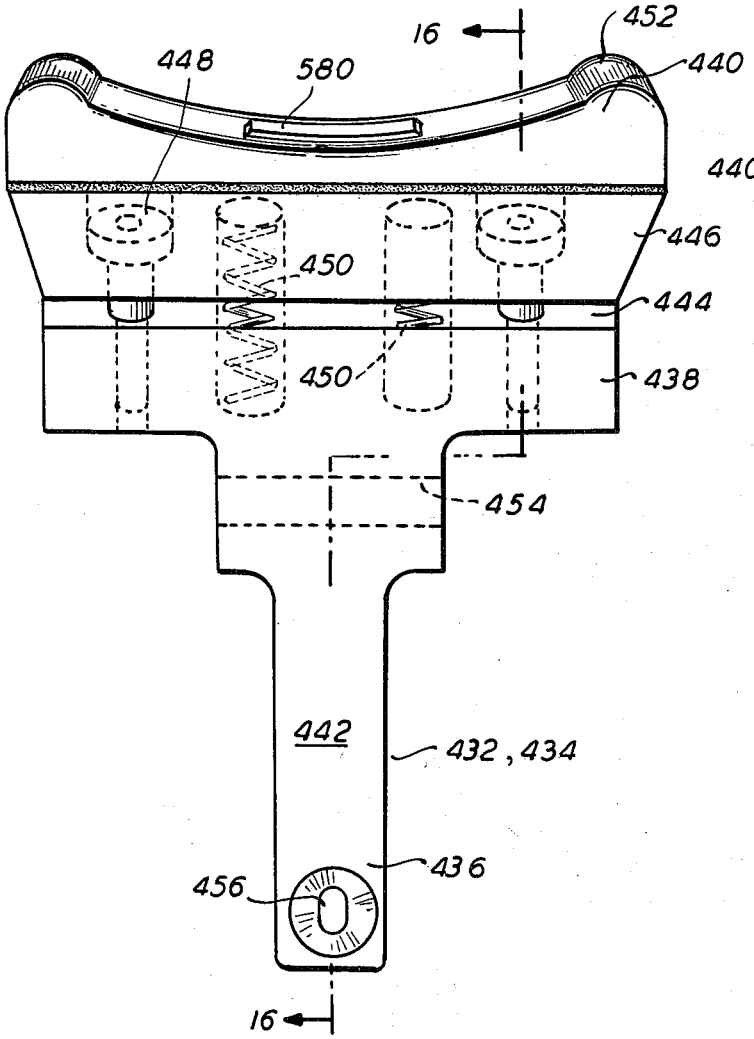
FIG. 15 is a plan view of one part of a cuff as employed in the alarm device of FIG. 14.
Figure 16:
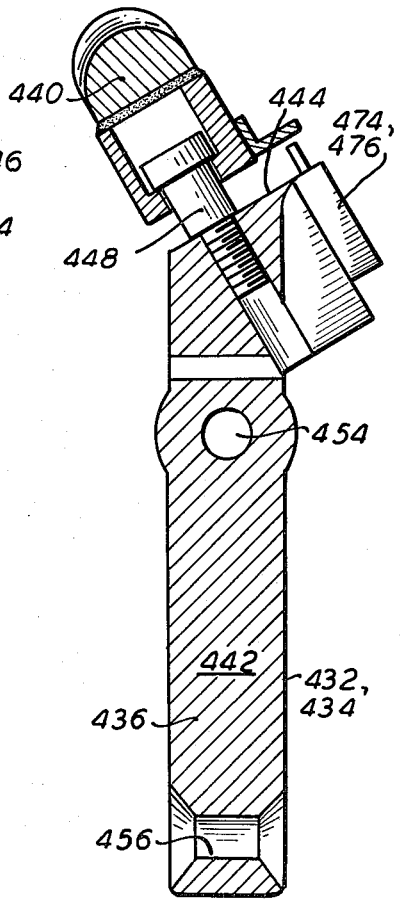
FIG. 16 is a side view of the cuff of FIG. 15.
Figure 17:
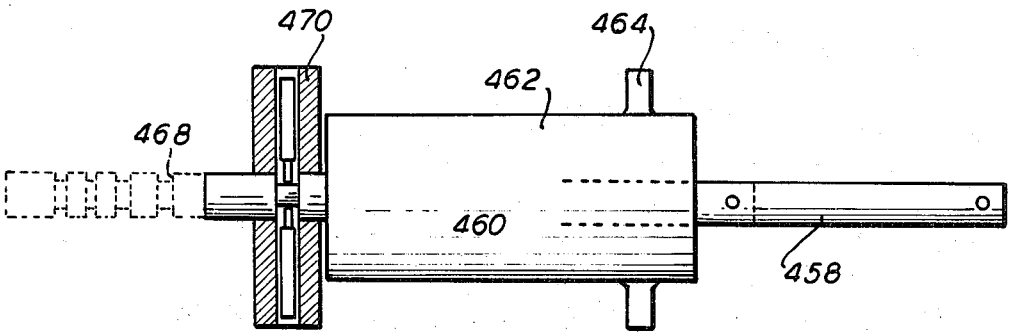
FIG. 17 is a piston shaft lock of the type used in the alarm device of FIG. 14.

Each arm 432 and 434 (FIGS. 15 and 16) generally comprise a T-shaped member 436 of any rigid material. The cross bar 438 of the T 436 may have secured thereto a cuff head 440. Each head 440 is secured to the cross-bar 438 to an angle of approximately 30 degrees with the stem 442 of the T 436. This angle is not regarded as being significant. The angle is formed by the cross bar 438, the top surface of which, 444, is disposed at an angle to accommodate the head 440. The head 440 comprises a body portion 446 resiliently mounted to the cross-bar 438 by means of shoulder bolts 448 countersunk therewithin and threaded into the cross bar 438. Resilient means, which may be, for example, helical springs 450, reside within apertures within the body portion 446 and cross bar 438. The cuff 452 of the head 440 may be made of, for example, hard rubber, and have a general C-shaped configuration. As previously indicated, the cuff arms 432 and 434 are pivotally mounted through axle apertures 454 therein. In the end of each stem 442 are apertured 456 intended to be engaged by the shaft of a flexible mount (FIG. 17). As previously indicated, each of the cuff arms 432 and 434 are respectively pivotally mounted at the pivot aperture 454 which is centrally disposed in the stem 442. The end of the arms 432 and 434 opposed to the cuffs 452 engage, through the aperture 456, a shaft 458. The shaft 458 is secured within a shaft housing 460. The shaft 458 has an enlarged portion 462 with arms extending radially therefrom for engaging a swivel mount 466 within the housing 460. The upper end of each shaft 458 is provided with a series of notches 468. A spring loaded power lock solenoid 470 is provided to engage the notches 468.

In operation, the user places his hand 472 (shown in phantom) into the center compartment 418. Because the center compartment 418 is fully visible the user can at all times see what is happening and is given confidence in the operation of the alarm box 400. The user presses with his hand 472 on the ledge 426 having therein the handle switch which may be, for example, a capacitance switch. Upon the operation, which includes the previously discussed sending of a tamper signal, the shafts 458 are released by the collar lock solenoids 470. It should be understood that the shafts 458 are an integral part of solenoids within the shaft housing 460. Thus, by the user operating the handle switch and sending the tamper signal, the cuff arms 452 are automatically lowered until they engage the arm 472 of the user. It should be noted (FIG. 16) that secured to the cross bar 438 of the T 436 of cuff arms 432 and 434, are switches 474 and 476, respectively. As the hand 472 is engaged by the cuff head 452, the switches 474 and 476 are operated by the moving inwardly of cuffs 452. After a predetermined period of time, the arms 432 and 434 may be released and lifted.

Figure 18:
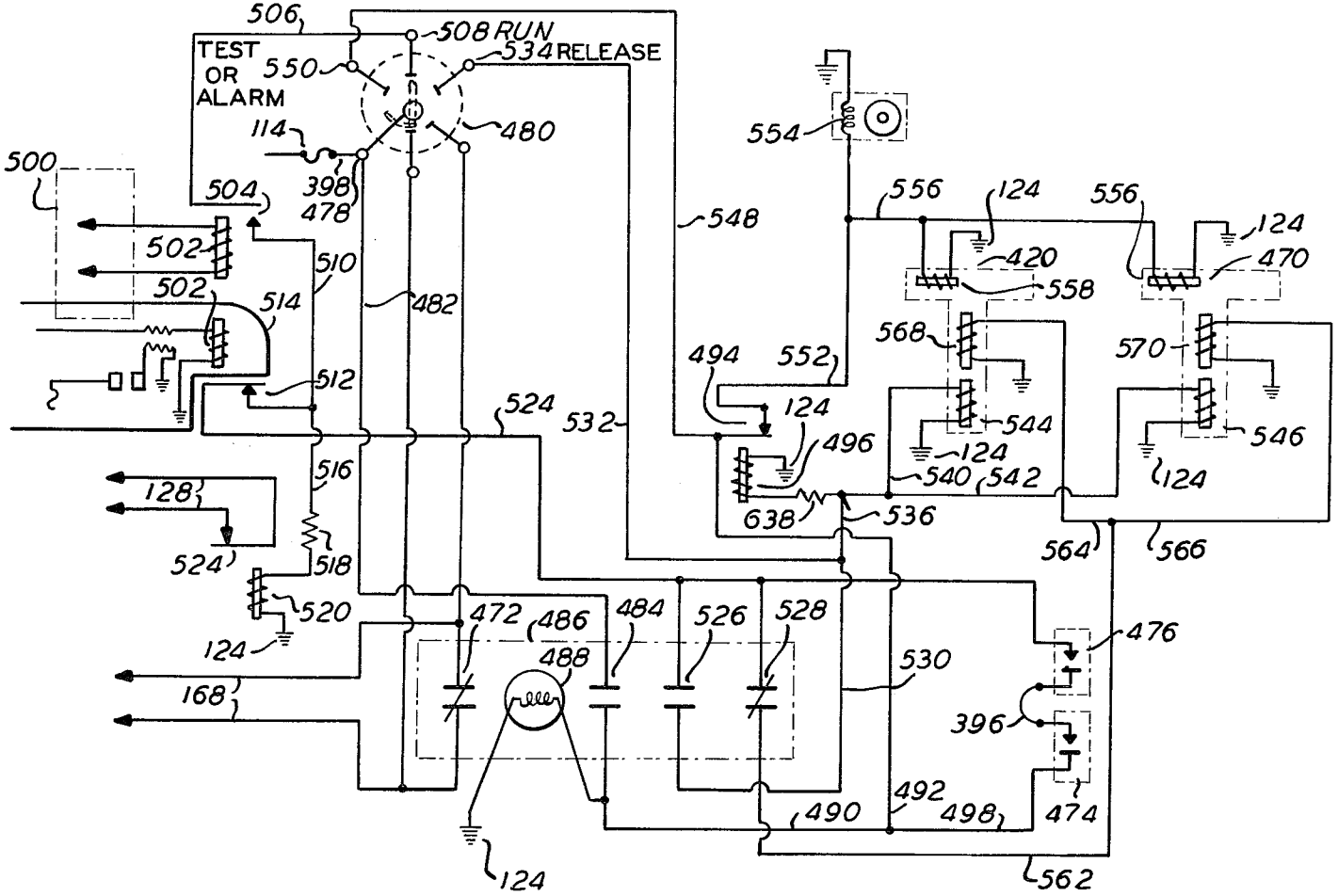
FIG. 18 is a schematic circuit diagram disclosing the system for controlling the alarm device of FIG. 14.

The operation may be more fully understood by a reference to the circuitry (FIG. 18). Thus, a source of voltage 114 is coupled to a switch throw 478, via line 398. The switch throw 478, part of a single-throw, multi-position, key-operated switch 480, is coupled, via line 482, to a first normally open timing contact 484 of a timing control 486. The other side of the first normally open timing contacts 484 is coupled to one side of the timing motor 488 and, via lines 490 and 492, to one side of a normally closed contact 494, associated with a switching relay coil 496. In addition, the same side of the normally open timing contacts 484 is coupled, via lines 490 and 498, to one side of one of the normally open, pressure-sensitive cuff switches 474.

The aforementioned alarm handle switch, as previously indicated, may be a capacitance switch 500 which discharges through a relay coil 502. It is understood that in the alternative, any switching mechanism may be provided as, for example, those disclosed in the previous devices herein. In this instance, the relay coil 502 is energized, opening the normally closed contacts 504 associated therewith. The normally closed contacts 504 are coupled, via line 506, to a contact or pole 508 of the key switch 480. With the throw 478 in the operating position, the power supply 114 is then coupled through line 398, throw 478 to contact 508, via line 506, to the normally closed contacts 504 of the relay 502. The other side of the normally closed contacts 504 is coupled, via line 510, to the normally closed contacts 512 of a metal sensing circuit 514, which will be more fully described hereinafter. The other side of the normally closed contacts 512 are coupled, via line 516, through a protective resistor 518, through a relay coil 520, and thence to ground 124. A pair of normally closed contacts 522 are across the secondary signal lines 128. Thus, with the key switch 480 in an operating position, it will be seen that the capacitance switch 500 energizes the relay 502 pulling open the normally closed contacts 504, thereby placing the power supply 114 through lines 480, throw 478, contact 508, line 506, contact 504, lines 510 and 156, resistor 518, through the relay 520, to ground 124, thereby opening the normally closed contacts 522 providing a tamper signal. The other side of the normally closed contacts 512 associated with the metal sensor circuit 514 may be coupled, via line 524, to one side of second normally open timing contacts 526 and first normally closed timing contacts 528 of the timing control 486, as well as to the other side of a normally open pressure-sensitive cuff switch 476. The other side of the cuff switches 476 and 474 are coupled to each other, thereby placing them in series, via line 396. The other side of the second normally open timing contacts 526 of the timing control 486 is coupled via lines 530 and 532, to another contact 534 of the multi-position key switch 480. The purpose of this contact 534 will be more fully discussed hereinafter. At the juncture of lines 532 and 530 is coupled, via line 536, through a protective resistor 538, through relay coil 496, to ground 124. The juncture of the resistor 538 and the line 536 is joined lines 540 and 542. Lines 540 and 542 are each connected to the double-action solenoid coils 544 and 546, respectively, which drive the shafts 458 in a downward direction for releasing the cuffs from the hand 472 of the user.

Coupled to the line 492 and joined at the juncture of one side of the normally closed contacts 494 of the relay 496 is line 548. Line 548 couples that side of the contacts 494 to a contact 550 of the key switch 480. The function of contact 550 will be more fully described hereinafter. The other side of the normally closed contact 494 may be coupled, via line 552, to a local bell signal coil 554. At the junction of the bell signal coil 554 and the line 552, and coupled thereto, is a line 556 for connecting in parallel to the coils 558 and 560 of the power lock solenoids. The power lock solenoids are, in turn, coupled to ground 124.

The other side of the first normally closed timing contacts 528 of the timing control 486 is coupled, via line 562, to lines 564 and 566. Lines 564 and 566 are connected, in turn, to one side of the solenoid 460 coils 568 and 570 that act to raise the shaft 458, thereby lowering the cuff arms 432 and 434 to force the cuffs 452 to engage the arm 472.

The complete operation of the system may now be more fully understood in light of the operation of the circuit. Thus, the user places his hand 472 into the compartment 418, pressing the capacitance switch 500 which places a voltage upon the coil 502, thereby pulling closed contacts 504. At this act, voltage 114 is applied, via the key switch 480, through contacts 478 and "operate" contact 508, lines 506, closed contacts 504, lines 510 and 516, through resistor 518 and coil 520, to ground 124 so as to open normally closed contacts 522, thereby producing a tamper or secondary signal along lines 128. At the same time, the voltage 114 is applied, via the normally closed contacts 512, line 524, through normally closed timing contacts 528 of the timing control 486, lines 562, 564, and 566, to the coils 568 and 570 of the solenoids controlling the motion of the shafts 458. As a result, the shafts 458 move upwardly so that the arms 432 and 434 are forced down against the arm 472 of the user.

At this moment, upon engagement of the arm 472 of the user, the switches 476 and 474 in the cuffs 452 close. The result is to place voltage 114 through throw 478 and contact 508 of the switch 480, lines 506, normally open handle switch contacts 504, lines 510, normally closed contacts 512 of metal detecting circuit 514, line 524, through the cuff switch 476, via line 396, to cuff switch 474, lines 498 and 490, to the timing motor 488, thereby starting the timing control 486 to work. At the same time, voltage 114 is applied, via the closed switches 476 and 474, along lines 498 and 492, through the normally closed contacts 494 of the switching relay 496, and line 552 to set off the bell signal 554, and at the same time to energize the coils 558 and 556 of the lock solenoids 470 through lines 556, so as to lock the arms 432 and 434 in their lowered positions. At that specific time, the first normally closed timing contacts 528 of the timing control 486 may be open, thereby removing the source of the voltage 114 from the solenoid coils 568 and 570, ending the downward movement of the cuff arms 432 and 434 against the arm of the user 472. Shortly thereafter, the second normally closed timing contacts 472 of the timing control 486 open, thereby sending the alarm or primary signal along alarm lines 168. Finally, near the end of the predetermined time, the second normally open contacts 526 close, applying the voltage 114 along line 520 to the switching relay coil 536, thereby opening the normally closed switch contacts 494, releasing the shaft locks by de-energizing the respective solenoid coils 556 and 558 and ceasing the audible alarm 554. At the same time, voltage source 114 is applied along lines 530, 540, and 542 to the solenoid coils 544 and 546 which then act to lower the shafts 458 and raise the arms 432 and 434, permitting the user to remove his hand 472.

In addition to the operation, the key switch 480 presents a number of other useful features which may be applied to all other devices presented herein. Thus, if the key switch 480 throw 478 is moved to the "test" contact 550, the voltage 114 is applied along line 480, contact 550, lines 548, through the normally closed contacts 494, to the audible bell 554, and to the shaft lock solenoids 556 and 558. At the same time, with the arms locked, the timing motor 488 is turned through an operation in which the normally open timing contacts 484 close, locking in the timing motor 488 and cycling it through an entire operation including the sending of an alarm along lines 168. However, since the normally open contacts 504 of the capacitive switch 500 are open, the cuff arms 432 and 434 do not move during this test operation. This permits the sounding of the audible signal and the receiving of an alarm signal without the sending of the tamper signal or secondary along line 128.

In another position of the key switch 480, the throw 478 is coupled to the "release" contact 534 so that the voltage 114 is applied along line 532 to the switching relay 496, thereby opening the circuitry to the shaft lock relay 556 and 568, as well as placing the voltage source 114 upon the coils 544 and 546, causing the cuff arms 432 and 434 to be pulled up. This safety measure may be applied in the event that there is a malfunction and the user's arm 472 is trapped within the box. Finally, a shunt 475 across contacts 474 and 476 may be provided on the key switch 480 to bypass an alarm when the alarm box 400 is being tested cyclically.

It will be seen that this type of key switch 480 may be conveniently designed with any of the other circuitries herein and used for testing this system. Like the second mentioned alarm box 190, it should be noted that the cuff arms 432 and 434 move automatically without having to be put in place by the user. In addition, complete visibility is provided to the user to see the movement of the cuff arms so as not to be unduly concerned thereby. It should be noted that the alarm box 400 itself has inserted within the compartments 418 and extending parallel the base two shelves 576 and 578 which are intended to prevent the user's hand or arm 472 from reaching in and disturbing the moving cuff arms 432 and 434.

Figure 18A:
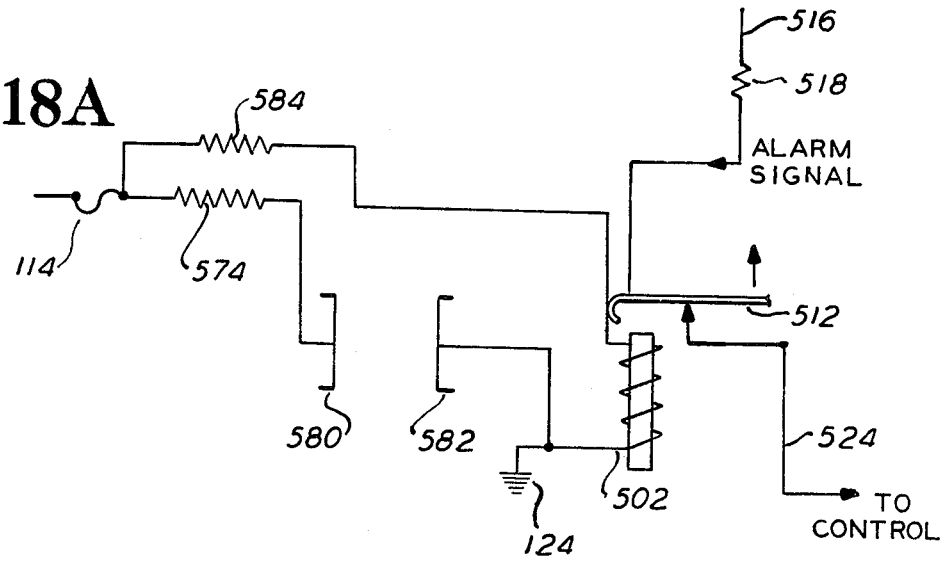
FIG. 18A is a circuit diagram of a metal detecting circuit used in connection with the circuit of FIG. 18.

During operation of this system, there is one area where some clever tamperer may attempt to foul the alarm box 400. In this instance, this may be done by the person placing about his hand 472 a tin can or other stiff metallic object. By setting off the alarm, the user may then remove his arm through the can, leaving the system operative. To make this box 400 fool-proof, a metallic sensor has been devised. The metallic sensing circuit (FIG. 18A) may comprise any well known combination of elements and is well known in the prior art. Thus, for example, the source of voltage 114 may be coupled, via a resistance 574, to one side of a metallic sensing head 580. This metallic sensing head 580 may be a metal strip or other conducting means located in each cuff 552. Thus, a second metallic strip 582 may be in the other cuff. A resistance 584 may be joined from the power supply 114 directly to relay coil 502. The relay coil 502 and other, second sensing head 582 may be connected to ground 124. If a tin can were inserted between the arms of the cuffs, the coil 502 would be energized opening the normally closed contacts 512, immediately denergizing the remainder of the circuit while permitting the sending of a tamper signal 128.

Turning now to another embodiment, there is provided fire alarm box 600 which, as previously discussed, may be a substantially rectangular rigid material box made, for example, of cast iron. Thus, the box 600 may have a top, bottom, and two side walls 602, 604, 606, and 608, respectively, as well as front and back walls 610 and 612. The front wall 610 may have therein, at the top, a viewing aperture 614 which may be enclosed with a glass or other translucent material (not shown). The bottom 602 may have therein an opening 616 through which the user may insert his hand (not shown). Within the alarm box 600 and rotatably secured to the side walls may be two equally dimensioned and equally shaped fly wheels 610 and 620, joined by a common shaft 622 and secured to the respective side walls 606 and 608 by means well known in the art. The fly wheels 618 and 620 are urged in a counterclockwise direction (arrow 626) by such resilient means as springs 628 and 638. The attachment of the springs 628 and 638 may be by means well known in the art. Thus, for example, with reference to one of the fly wheels 618 at the left side 606 of the alarm box 600, there may be, for example, a helical spring 628 secured at one end by a pin 630 formed as an integral part of an L bracket 632. The L bracket 632 may be secured to the corner intersection of the side wall 606 and the bottom wall 604 as by bolts 634. The other end of the coil spring 628 may be secured to the fly wheel 618 at a pin 636. The pin 636 may be so disposed so that the natural tension of the spring 628 would be to urge the fly wheel 618 in a counterclockwise direction (arrow 626). The second spring 638 is connected by means of a bracket 640 connected to the front wall 610. The opposed end of the spring 638 may be connected to the fly wheel 618 in a counterclockwise direction (arrow 626). Thus, for example, the springs 628 may be secured above a diameter which is parallel to the base 604 and the spring 638 secured to the fly wheel in a position below that diameter with the fly wheel 618 in a fully wound position. A similar set of springs (not shown) may be attached to the other fly wheel 620. The first fly wheel 618 secured to the opposed fly wheel 620 by the common shaft 622 and a bar 642. The bar 642 and shaft 622 assure that the two fly wheels 618 and 620 will turn together. Connected to the bar 642, as by means of a U-shaped bracket 644 is a cuff housing 646. Movably secured within the cuff housing 646 is an elongated rod-like member 648 (FIG. 19). The rigid rod member 648 is movably held by the cuff housing 646. Thus, for example, the rod 648 may have an elongated enlarged end such as a bolt head (not shown) which prevents its removal from the housing 646. The rod 648 is movable through an aperture (not visible) in the housing 646. The other end of the rod 648 may be pivotally secured by a pin 650 within a bracket 652. The bracket 652 may be secured to the front wall 610 by means well known in the art. It will be noted that with the fly wheels 618 and 620, in a fully spring-loaded position (FIG. 14), the rod 648 extends upwardly at a slight acute angle with respect to a horizontal line extending through the pin 650. The cuff housing 646, as previously indicated, is rigidly mounted to the U-shaped bracket 644 which in turn is rigidly secured to the bar 642, such that it is assured that the cuff housing 646 will turn with the motion of the fly wheel 618 and 620. Extending from the forward end of the housing 646 and in axial alignment with the rod 648 is an elongated cuff member 654 which is resiliently secured to the cuff housing 646. Thus, the cuff member 654, which may be in the form of a rectangularly shaped hard rubber member, may be secured to the housing 646 by a rod support 656 having a helical coil spring 658 thereabout to resiliently support the cuff 654. Secured to the back wall is a matching rectangularly shaped opposing cuff 660 which may also be made of hard rubber. This second cuff pad 660 has at least one rod member 662 disposed through a C-bracket 664 and a spring 666 about the rod 662 resiliently hold the pad 660 in an outward direction. Means may be provided such as a washer 668, on the opposed side of the C-bracket 664, to prevent the removal of the cuff 660. With this arrangement, it will be seen that as the fly wheels 618 and 620 turn in a counterclockwise direction (arrow 626) the cuff heads or members 654 and 660 will tend to come together.

The alarm box 600 is supplied with an alarm handle 670. The alarm handle 670 comprises an elongated bar disposed above the fly wheels 618 and 620, arranged horizontally and movably secured to the side walls 606 and 608. The alarm handle 670 may be generally described as I-shaped, with the cross bars 672 and 674 of the I disposed vertically and the interconnecting member 676 being placed horizontally. Each of the cross-bars 672 and 674 may be held movably in place as by bracket tracks 678 and 680, respectively. Each of the bracket tracks 678 and 680 may be secured to the respective side walls 606 and 608 by bolts or other means as well known in the art. At the bottom of the cross bar 672 and 674 and extending horizontally and inwardly of the side wall 606 and 608, may be integrally formed fly wheel engaging fingers 682 and 684. Each of the fly wheels 618 and 620 may have cut therein a notch to accommodate the rectangular cross sectional configuration of the fingers 682 and 684. Thus, with the fly wheels 618 and 620 in a fully wound or spring-loaded position, the finger 682 and 684 engage the fly wheels 618 and 620 holding them in that position until operation begins.

As previously indicated, the fly wheels 618 and 620 are oriented so that they are parallel the side walls 606 and 608, respectively. The rearward portion of each fly wheel 618 and 620, while being substantially disc shaped and circular, have an eccentric camming portion 686. The eccentric portion 686 comprises gear teeth extending outwardly and in increasing radial distance in the counterclockwise direction 626. Each of these gear teeth are intended to engage a camming wedge surface 688 having gear teeth therein as well. Thus, it will be appreciated that if the fly wheels 618 and 620 are moved in a clockwise direction, they shall move freely but in the counterclockwise direction (arrow 626), they shall increasingly engage the facing gear teeth of the camming surface 688 by means of eccentric teeth 686. The camming surface 688 is so disposed, such that the as the wheels 618 and 620 turn in a counterclockwise direction (arrow 626), there is increasing resistance to their turning so that the effective force of the fly wheels 618 and 620 will not crush the user's arm engaged by the cuff pads 654 and 660. It will be noted that as the handle cross bars 672 and 674 are moved upwardly, one of the cross bars 672 will engage a switch 690 secured to one of the side walls 606.

Within each of the cuff handle sleeves, as in prior art devices, there may be a pressure-sensitive switch (not fully visible).

Figure 21:
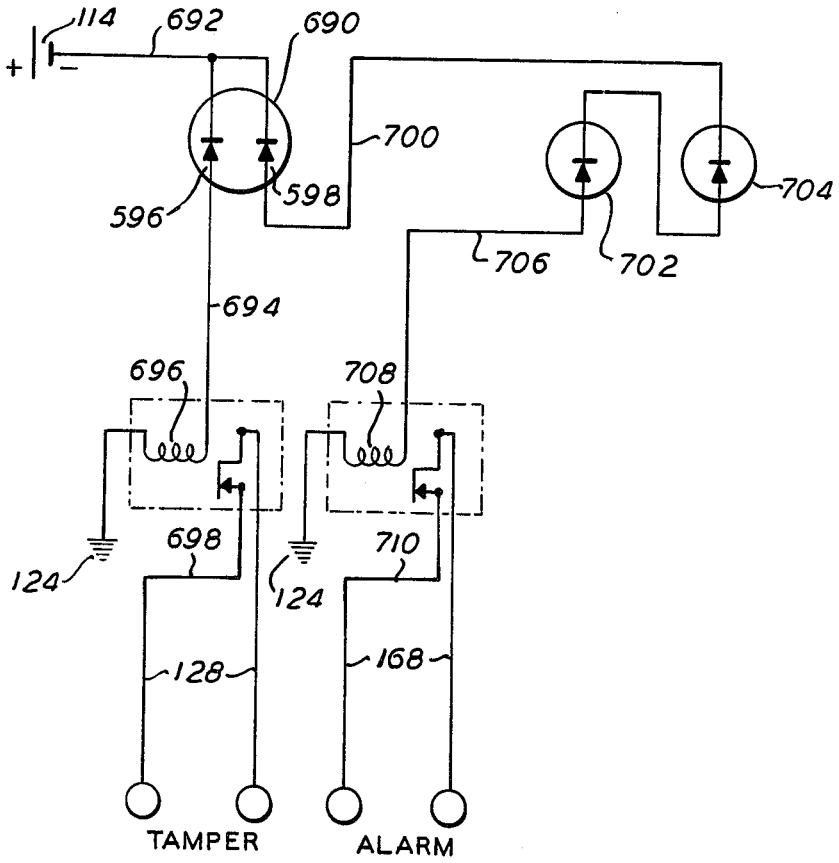
FIG. 21 is a schematic circuit diagram of a system for operating the alarm box of FIG. 19.

The operation of the device 600 will be more fully described in connection with the circuitry (FIG. 21). Thus, there is provided a source of voltage 114 which is coupled via line 692 to one side of the switch 690 which may comprise two mechanically ganged, single-pole, normally open, pressure-sensitive switches 596 and 598. One side of one switch 596 may be connected, via a line 694, to a relay 696 and thence to ground 124. The normally closed contacts 698 of the relay 696 may be connected across a secondary signal line 128. The other second gang switch 598 may be connected, via line 700, through one side of one of the cuff switches 702. The cuff switches 702 and 704 are, as indicated in prior devices, normally open, single-pole, single-throw switches 752 and 754, connected in series. The other side of the switches 702 and 704 may be coupled, via line 706, to a coil 708 and thence to ground 124. The normally closed contacts 710 associated with the relay coil 708 are across the primary signal line 168.

In operation, the user looks through the viewing aperture 614 to see a large handle 670. The user reaches in through the aperture opening 616 to grasp the handle 672, moving it in an upward direction arrow 712. In so doing, the handle 670 engages and closes the switch 690 providing voltage 114 along lines 692, 694, through relay 696, opening contacts 698 and placing a secondary signal on lines 128. As this is done, the handle fingers 682 and 684 release the fly wheels 618 and 620. The fly wheels 618 and 620 move in a counterclockwise direction (arrow 626), such that the teeth 686 begin to engage the camming surface 688. An arm of the user disposed between the cuffs 660 and 654 is engaged as the wheels 618 and 620 move forward along the two cuff switches 702 and 704 in the cuffs 654 and 660 close, thereby providing the voltage through source 114 via line 692, 690 lines 700, switches 704 and 702, lines 706, and relay coil 708, thereby placing the primary signal line on line 168.

A door (not indicated) may be provided in the rear wall 612 of the housing 600. With the door open, the cuff 660 is swung away from the user releasing him from the box 600. Differing from the other devices herein, the user is only released by this means and is not held for a predetermined time. It should be understood, that shields 714 and 716 may be provided to block the user's access to mechanisms of the box 600.

It will be understood that the devices herein are merely exemplary of the invention and various of the circuit features may be adapted to other versions. Thus, for example, a means might be provided to automatically turn the fly wheels 618 and 620 to an open position after a predetermined time.

One over-all feature of the devices herein should not be ignored. The presence of spaced cuffs with siwtches therein required to be closed in order to send the alarm signal, assumes that a tamperer cannot simultaneously close both unless grasped by the cuffs. A pole or other means will not work unless the tamper signal (or handle) switch has been closed as well. These devices are designed to make impractical and thus eliminate the tamperer who sends alarms and then leaves the scene, thereby endangering life and property.

What is claimed is:

1. An alarm providing device of the type requiring manual operation by the user and employing a source of electrical power, said alarm comprising:

(a) secondary signal means for providing a secondary signal in response to the manual operation;

(b) means for detaining the user of the device; and (c) primary signal means, responsive to said detaining means, and operative in dependence upon said response of said secondary signal means, for providing a primary signal upon the user being detained by said detaining means; said primary signal being indicative of the alarm.

2. An alarm device as recited in claim 1, wherein said detaining means detains the user for a predetermined period of time.

3. An alarm device as recited in claim 2, further comprises a housing; said second signal means comprises a handle means secured to said housing and at least one electrical switch means disposed upon said handle for manual engagement.

4. An alarm device as recited in claim 3, wherein said detaining means comprises a pair of opposed cuffs, said cuffs being closable upon the arm of the user, and means for holding said cuffs in said closed position for said predetermined period of time.

5. An alarm device as recited in claim 4, wherein said primary signal means comprises at least one switch means in each of said cuffs so disposed as to operate upon sensing a predetermined pressure upon said cuffs.

6. An alarm device as recited in claim 5, wherein said primary signal means being responsive to said cuff switch and said handle switch means such that said primary signal being provided upon said handle switch and said cuff switch means being operated.

7. An alarm device as recited in claim 6, wherein said detaining means comprises timing control means responsive to said handle switch and cuff switch means such that said timing control means in response to said operation of said handle switch and cuff switch means becomes operative to hold said cuffs against the arm of the user for said predetermined period of time.

8. An alarm device as recited in claim 7, wherein one of said cuffs being secured to said housing and the other of said cuffs being secured for relative movement with respect to said housing.

9. An alarm device as recited in claim 8 further comprising: housing cover means hingedly secured to said housing for relative movement with respect to said housing; said movable cuff being secured to said housing cover means; said cuffs being disposed below said handle; said housing cover means enclosing said handle; said detaining means further comprises means for engaging said housing cover means upon said operation of said handle switch means to restrain said housing cover means from being moved hingedly away from said housing to thereby prevent an increase in the space between said cuffs.

10. An alarm device as recited in claim 9, wherein said housing cover means having a portion engageable with said housing and being disposed such that the cuffs are proximate one another with said cover in a closed position.

11. An alarm device as recited in claim 10, further comprises cover sensing switch means for sensing the presence of said cover housing means engaging said housing; said means for engaging said cover housing means being responsive to said sensing switch means so as to engage said housing cover means upon said operation of said handle switch and said cuff switch means.

12. An alarm device as recited in claim 11, wherein said housing being adapted to be joined to a standard alarm box; means, responsive to said primary signal, to operate a standard alarm box.

13. An alarm device as recited in claim 12, wherein said means to engage and operate a standard alarm box comprises means for engaging and pulling an alarm box alarm handle.

14. An alarm device as recited in claim 11, further comprises means responsive to said cuff switches being closed to indicate to the user that said device is enabled to provide said primary signal.

15. An alarm device as recited in claim 14, wherein said means to indicate to the user that said device is enabled comprises a bell, said bell having a coil winding responsive to said cuff switches being operative.

16. An alarm device as recited in claim 11, wherein said secondary signal means providing said secondary signal upon said manual operation of said handle switch means; said handle switch means being capable of coupling the source of power to said secondary signal means;

said timing control means being operative in response to said handle cuff, and cover sensing switch means so as to cause the operation of said primary signal means providing said primary signal and said means for engaging said cover holding said cover means for said predetermined time.

17. An alarm device as recited in claim 16, wherein said manual operation of said handle switch means causes said handle switch means to be capable of coupling a source of power through said cuff switch means of both of said cuffs to operate said means for engaging said cover;

said cover sensing switch means upon sensing said cover means thereby coupling said cuff switch means of both of said cuffs to said timing control means, thereby being capable of providing the source of power to cause said timing control means to operate;

said timing control means, in response to said cover sending switch means, being enabled to couple directly to the source of power for said predetermined time;

said timing control means, upon being directly coupled to the source of power, thereby enabling said primary signal means to provide said primary signal during said predetermined time; said timing control means comprises means for releasing said means for engaging said cover; said releasing means being operative within a time period coincident with and ending just before the termination of said predetermined time to thereby make inoperative said engaging means.

18. An alarm device as recited in claim 17, wherein said timing control means being capable of recycling to provide a second of said predetermined periods of timing providing said handle, cuff, and cover sensing switch means are operative.

19. An alarm device as recited in claim 18, wherein said handle switch means comprises a manually operable, single-pole, single-throw switch;

said second signal means comprises a relay coupled between said handle switch and ground and normally closed contacts; upon said normally closed contacts opening to thereby provide said secondary signal; said cuff switch means comprises a pressure-sensitive, single-pole, single-throw switch in each of said cuffs and being connected in series to one another;

said cover sensing switch means comprises a single-pole, single-throw pressure sensitive switch; said timing control means comprises a timing motor and a normally open and first and second normally closed timing contacts responsive to said timing motor; said handle switch being coupled through said second normally closed timing contacts through said cuff switches to said means for engaging said cover; said cuff switches being coupled through said cover sensing switch to said timing motor to cause said timing motor to operate; said normally open timing contacts being capable of coupling said timing motor to the source of power such that upon said timing motor operating said normally open contacts close to cause said direct couple;

said primary signal means comprises first normally closed timing contacts; said timing control motor opening said first normally closed contacts to provide said primary signal; said means for releasing said engaging means comprises said second normally closed timing contacts coupling said handle switch to said cuff switches.

20. An alarm device as recited in claim 19, wherein said means for engaging said cover comprises a solenoid, said cover having an aperture therein, said solenoid plunger engaging said aperture, said aperture being so dimensioned such that upon being engaged by said plunger said cover may be moved toward said housing and stopped from being moved away from said housing.

21. An alarm device as recited in claim 20, wherein said cover having a viewing aperture through which said cuffs and said handle are visible.

22. An alarm device as recited in claim 11, wherein said engaging means comprises a solenoid having a plunger and said cover having an engageable aperture therein and within said housing, said housing comprises a substantially rectangular box-like structure having said handle and one of said cuffs secured to a front wall; said cuff being secured for resilient movement with respect to said wall; said cover being hingedly connected along one wall thereof to the top of said front wall of said housing; said cover having at least a front wall, side and bottom walls; said front wall of said housing having a U-shaped aperture therein for receiving said side and bottom walls of said cover; said bottom wall of said cover being arcuately contoured and having therein said aperture for being engaged by said cover engaging means; said engageable aperture having a tear shape extending perpendicularly to said front wall of said housing and disposed so that said solenoid plunger becomes wedged against said aperture upon said cover being hingedly moved outwardly; said cover bottom wall having therein a larger, arm admitting aperture for receiving the arm of the user.

23. An alarm device as recited in claim 16, wherein said manual operation of said handle switch means and the closing of said cover sensing switch means is capable of coupling the source of power through said timing control means and both of said cuff switch means to thereby provide the source of power to said timing control means to become operative for said predetermined period;

said timing control means, in response to the source of power being coupled thereto, being enabled to be capable of coupling the source of power directly to said timing control means; said timing control means in response to being operative being capable of coupling the source of power directly to said cover engaging means to hold said cover cuff against the user for a period of time coincident with said predetermined time but ending just before the end of said predetermined time; said timing control means, upon being directly coupled to the source of power, thereby enabling said primary signal means to provide said primary signal during said predetermined time.

24. An alarm device as recited in claim 23, wherein said timing control means being capable of recycling to provide a second of said predetermined periods of time providing said handle, cuff, and cover sensing switching means are operative.

25. An alarm device as recited in claim 24, wherein said handle switch means comprises two mechanically ganged, single-pole, single-throw switches;

said secondary signal means comprises a relay coupled between one of said handle switches and ground and normally closed contacts which, upon being opened by said relay, provide said secondary signal;

said cuff switch means comprises each cuff having therein a pressure-sensitive single-pole, single-throw switch, said cuff switches being connected in series; said cover sensing switch means comprises a single-pole, single-throw switch said timing control means comprises a timing motor and first and second normally closed timing contacts and first and second normally open timing contacts responsive to said timing motor; said first and second normally open timing contacts and said second normally closed timing contacts being capable of coupling the source of power such that said first normally open contacts is coupled to said timing motor; said second normally open contacts being coupled to said cover engaging means; said second normally closed contacts being coupled through said cover sensing switch, second handle switch, and cuff switches to said first normally open contacts and said timing motor.

26. An alarm device as recited in claim 25, wherein said means for engaging said cover comprises a solenoid within said housing, said cover comprises a latch for engaging said housing; said solenoid plunger engaging said latch to lock said cover to said housing.

27. An alarm device as recited in claim 11, wherein said housing comprises a substantially rectangular box-like structure having said handle and one of said cuffs secured to a front exterior wall; said housing cuff being resiliently secured to said housing; said cover comprising a substantially rectangular structure for closing upon said housing and forming therebetween a substantially rectangular container with said cuffs and said handle therein, said cover being hingedly connected to said housing along a vertical side thereof; said housing and cover adjacent side walls having a latch, said housing having an aperture for receiving said latch, said plunger being disposed within said housing to engage said latch within said housing to hold said cover in a closed position during said predetermined period.

28. An alarm device as recited in claim 8, wherein said movable cuff comprising means responsive to said manual operation of said handle switch means to move said movable cuff into proximity of said housing cuff so as to be capable of engaging therebetween the arm of the user.

29. An alarm device as recited in claim 28, wherein said means for moving said movable cuff comprises means for, at the end of said predetermined time, removing said movable cuff.

30. An alarm device as recited in claim 29, wherein said secondary signal means providing said secondary signal upon said manual operation of said handle switch means; said handle switch means being capable of coupling a source of power to said secondary signal means;

said timing control means being operative in response to said cuff switch means so as to cause the operation of said primary signal means providing said primary signal and said detaining means for said predetermined time.

31. An alarm device as recited in claim 30, wherein said manual operation of said handle switch means causes said handle switch means to be capable of coupling the source of power through each of said cuff switch means to operate said timing control means and said means for moving said movable cuff; said timing control means in response to said handle and cuff switch means being enabled to couple directly to the source of power; said timing control means, upon being coupled directly to the source of power, enabling said primary signal means to provide said primary signal during said predetermined time; said timing control means comprises means for holding said means for moving said cuff means for a period of time less than but coincident with said predetermined time; and means for removing said holding means and causing said means for moving said cuff means thereby removing said movable cuff at the end of said predetermined time.

32. An alarm device as recited in claim 31, wherein said timing control means being capable of recycling to provide a second of said predetermined periods of time providing said handle switch means are operative.

33. An alarm device as recited in claim 32, wherein said handle switch means comprises a manually operable, single-pole, single-throw switch;

said secondary signal means comprises a relay coupled between said handle switch and ground and normally closed contacts which, upon being opened by said relay, thereby provides said secondary signal; a locking solenoid coil; said timing control means comprises a timing motor and first and second normally open timing contacts and first and second normally closed timing contacts;

said cuff switch means comprise pressure-sensitive, normally open single-pole, single-throw switch in each of said cuffs and in one of said cuffs, a normally closed single-pole, single-throw pressure sensitive switch mechanically ganged to one of said cuff switches;

said normally open cuff switches being connected in series and being capable of coupling the source of power to said timing motor; said first normally open timing contacts in response to said timing motor closing to be capable of directly coupling the source of power to said timing control motor; said means for moving said movable cuff comprising a double actionsolenoid and a solenoid single-pole normally closed switch; said handle switch being capable of coupling the source of power to one of the windings of said double action solenoid such that said double action solenoid causing said movable cuff to move into engagement with said housing cuff; said one winding of said double action solenoid being coupled through said normally closed cuff contact to ground such that upon said normally closed cuff switch opening the circuit comprising said one winding, ending said downward movement; said second normally closed contact being capable of coupling the source of power to said locking solenoid coil and to ground; said timing motor opening said second normally closed timing contacts to release said solenoid lock coil to thereby engage said means for moving said cuff and hold said movable cuff in place; said first normally closed contact opening thereby providing said primary signal, said second normally open timing contacts being capable of coupling the source of power through said double action solenoid switch to the second coil of said double action solenoid and to ground; said second normally closed contacts closing after said predetermined time causing said double acting solenoid to cause said moving means to remove said movable cuff; said second normally closed contacts closing at the end of a period of time coincident with said predetermined time but terminating before the end of said predetermined time thereby releasing said means for moving said movable cuff; thereafter, said first normally open timing contact opens disconnecting said timing motor.

34. An alarm device as recited in claim 8, wherein said housing comprises an substantially rectangular box-like structure; said detaining means comprises a double action solenoid, an arm pivotally secured to said housing and extending without said housing front wall above said handle; said cuffs being disposed below said handle; said housing having a cover portion for enclosing said front wall and through which may be viewed said cuffs and handle; said cover having an aperture therein for receiving the arm of the user; said detaining means arm being engaged by said double action solenoid for moving said movable cuff into and out of engagement with the arm of the user; and solenoid locking means for locking said cuff arm against the user arm.

35. An alarm device as recited in claim 34, wherein said double action solenoid plunger is disposed to move vertically within said housing; said arm having a slot; said double action solenoid plunger comprises a pin for engaging said slot such that with said plunger moving upward, said arm being moved upwardly such that the opposed cuff end thereof moves downwardly; said solenoid locking means comprises a solenoid lock at said pivot point of said arm and within said housing; said arm comprising a substantially rigid member.

36. An alarm device as recited in claim 7, wherein said cuffs being secured to said housing for relative movement with respect to said housing.

37. An alarm device as recited in claim 36, wherein said detaining means further comprises means for moving said cuffs into engagement with the arm, holding said cuffs against the arm and, at the end of said predetermined time, removing said cuffs.

38. An alarm device as recited in claim 37, further comprises means for detecting the presence of a metal object between said cuffs so as to disengage said primary signal means.

39. An alarm device as recited in claim 37, further comprises said secondary signal means providing said secondary signal upon said manual operation of said handle switch means; said handle switch means being capable of coupling the source of power to said secondary signal means;

said timing control means being operative in response to said handle and cuff switch means so as to cause the operation of said primary signal means providing said primary signal and said detaining means for said predetermining time.

40. An alarm device as recited in claim 39, wherein said manual operation of said handle switch means causes said handle switch means to be capable of coupling the source of power through each of said cuff switch means to operate said timing control means; said handle switch means being capable of coupling the source of power to said moving means to cause said cuffs to move into engagement with the arm of the user;

said timing control means, in response to said handle and cuff switch means being enabled to couple directly to the source of power; said timing control means in response to the source of power being capable of enabling said primary signal means to provide said primary signal during said predetermined time; said timing control means comprises means for holding said moving means.

41. An alarm device as recited in claim 40, wherein said timing control means being capable of recycling to provide a second of said predetermined periods of time providing said handle switch means are operative.

42. An alarm device as recited in claim 41, further comprises test means for operating said moving means independently of said primary signal means to thereby provide an emergency release of the arm of the user.

43. An alarm device as recited in claim 42, wherein said test means further comprises means for separately operating said timing means independently of said secondary signal means.

44. An alarm device as recited in claim 40, wherein said handle switch means comprises a capacitance switch operated relay, the normally open contacts of said relay being capable of being in series with the source of power; said secondary signal means comprises a relay coupled between said normally open relay contacts of said handle switch and ground and having normally closed contacts which upon closing of said handle switch contacts said normally closed relay contacts opening thereby providing said secondary signal;

said timing control means comprising a timing motor and first and second normally closed timing contacts and first and second normally open timing contacts;

said cuff switch means comprising series connected single-pole, single-throw pressure-sensitive switches in each of said cuffs; said moving means comprising double action solenoid means coupled to each of said cuffs for moving said cuffs into and out of engagement, relay switching means for changing the direction of movement of said cuffs, and locking means for holding said cuffs in position; said handle switch means being capable of coupling the source of power through said second normally closed timing contacts to said solenoid means for moving said cuffs into engagement such that upon the closing of said normally open handle switch contacts said cuffs begin to close upon the arm of the user; said cuff switches being coupled to the source of power by said handle switch contacts and to said timing motor so that upon closing of said cuff switches, said timing means initiates operation for said predetermined time; said first normally open timing contacts being capable of coupling said timing motor directly to the source of power upon said initiation of said operation; said first normally closed timing contacts comprising said primary signal means and upon opening in response to said timing motor providing said primary signal; said first normally closed timing contacts remaining open for said predetermined time said cuff switches being capable of coupling the source of power provided by said handle switch contacts directly to said locking means such that upon closing said cuff switches said cuffs being thereby locked in position for a period of time coincident with said predetermined time but ending just before the end of said predetermined time;

said second normally open timing contacts coupling from the source of power provided by said handle switch contacts to said relay switching means and said solenoid means and closing at the end of said coincident time to disconnect from said circuit said lock means and initiating said solenoid means to move said cuffs away from the arm of the user;

said second normally closed timing contacts coupling the source of power provided by said switch handle contacts to said solenoid means to move said cuffs into engagement at the beginning of said predetermined time and opening at a time after said cuff switches close.

45. An alarm device as recited in claim 44, wherein said cuffs comprise metal detector means for opening said circuit between said handle switch contacts and said second normally open and normally closed timing contacts and said cuff switches to prevent said timing motor from initiating operation and sending said primary signal.

46. An alarm device as recited in claim 45, wherein said metal detector means comprises electrically conductive strips on both of said cuff impedances and a relay coil; said impedances being coupled between the source of power and said conductive strips such that a shorting of said strips reduces said total impedance thereby increasing the flow of current to said relay to operate said relay contacts.

47. An alarm device as recited in claim 45, further comprises test switch means comprising a multi-position switch for coupling the source of power to said handle switch means in one position; said relay switching means comprising a relay and normally closed contacts; said test switch means coupling the source of power directly to the juncture of said cuff switch means and said relay switching means on one side of said contacts so to operate said timing control means and said solenoid means in another position to thereby provide said primary signal and move said cuffs into an engaging position; said test switch coupling the power source to said switch means to release said locking means and to said solenoid means to cause said cuffs to disengage.

48. An alarm device as recited in claim 7, wherein said housing comprises a generally rectangular housing having three compartments therein; said cuffs comprise arms pivotally secured to two of said compartments for movement from said two compartments into and out of said third, central compartment; said compartments defined by two walls disposed parallel the side walls of said housing; said cuff arms pivot within said third central compartment through apertures in said two walls; said handle disposed upon one of said two walls and within said central department; said detaining means comprises solenoid driving means for moving said cuffs into and out of engagement with the arm of the user disposed within said third compartment in response to manual actuation of said handle.

49. An alarm device as recited in claim 48, wherein said cuff arms comprise elongated rod-like members, pivotally mounted and having cuff heads angulated so as to engage and hold the user's arm inserted therein such that an arm pushing downwardly against said cuffs causes said cuffs to tighten thereagainst.

50. An alarm device as recited in claim 49, wherein said housing comprises a front wall covering said compartments and in which portion of said front wall disposed in front of said third central compartment being translucent, and having an arm receiving aperture in the bottom wall of said third compartment.

51. An alarm device as recited in claim 1, wherein said detaining means comprises a pair of opposed cuffs being closable upon the arm of the user and means for holding said cuffs in said closed position.

52. An alarm device as recited in claim 51, wherein said primary signal means comprises at least one switch means in each of said cuffs so disposed as to operate upon sensing a predetermined pressure upon said cuffs.

53. An alarm device as recited in claim 52, further comprises handle means movably secured to said housing and at least one electrical switch means disposed for engagement by said handle.

54. An alarm device as recited in claim 53, wherein said primary signal means being responsive to said cuffs and said handle switch means such that said primary signal being provided upon said handle and cuff switch means being operated.

55. An alarm device as recited in claim 54, wherein said detaining means comprises fly wheel means rotatably secured to said housing; resilient means for urging said fly wheel means into movement; said handle means comprises means for holding said fly wheel means; at least one of said cuffs being secured to and movable by said fly wheel means such that upon release of said fly wheel means by said handle means said fly wheel means rotates to move said fly wheel cuff toward said other cuff.

56. An alarm device as recited in claim 55, wherein said handle switch comprises two single-pole, single-throw switches mechanically ganged together; said cuff switches comprise single-pole, single-throw switches in each of said cuffs; said handle switches being capable of coupling a source of power; a first of said handle switches being capable of coupling the source of power to said secondary signal means, said second handle switch being capable of coupling the power through said cuff switches to said primary signal means.

57. An alarm device as recited in claim 55, wherein said housing comprises a camming wedge, said fly wheel means comprises two fly wheels, each having a camming surface at the periphery thereof, said camming surface comprising teeth for engaging said camming wedge to halt said cuff movement at a predetermined point; said fly wheels joined by a common shaft; said movable cuff being secured to a wall of said housing and to said wheels.

* * * * *